US005865342A

United States Patent [19]

Ito et al.

[11] Patent Number: 5,865,342

[45] Date of Patent: Feb. 2, 1999

[54] MEDICATION FILLING APPARATUS

[75] Inventors: Kenichi Ito; Toshiyuki Niijima, both of Gunma-ken, Japan

[73] Assignee: Sanyo Electric Co., Ltd., Osaka, Japan

[21] Appl. No.: 708,577

[22] Filed: Sep. 5, 1996

[30] Foreign Application Priority Data

Sep. 5, 1995 [JP] Japan ..... 7-251910

[51] Int. Cl.[6] ..... G07F 11/00

[52] U.S. Cl. ..... 221/265; 221/157; 221/233; 221/234; 221/258; 221/263; 221/264; 198/691

[58] Field of Search ..... 221/265, 135, 221/157, 233, 234, 258, 263, 264; 198/691, 397

[56] References Cited

U.S. PATENT DOCUMENTS

| | | | |
|---|---|---|---|
| 2,621,096 | 12/1952 | Broyles et al. | 221/265 |
| 3,294,284 | 12/1966 | Chambers | 221/120 |
| 3,942,645 | 3/1976 | Aronson | 221/157 |
| 4,479,573 | 10/1984 | Ackley, Sr. et al. | 198/398 |
| 5,074,824 | 12/1991 | Suris | 221/265 |

FOREIGN PATENT DOCUMENTS

| | | | |
|---|---|---|---|
| 0 502 526 A1 | 9/1992 | European Pat. Off. | A61J 7/00 |
| 0 719 537 A2 | 3/1996 | European Pat. Off. | A61J 7/00 |

*Primary Examiner*—William E. Terrell
*Assistant Examiner*—Khoi H. Tran
*Attorney, Agent, or Firm*—Darby & Darby

[57] ABSTRACT

A medication filling apparatus is equipped with a tablet case for holding medications and a dispensing drum which lets the medications fall through an outlet from the tablet case as it rotates, thereby dispensing the medications; it is further equipped with a plurality of grooves into which the medications from the tablet case are fed and which let the medications fall therefrom when they are aligned with the outlet; and a separating member which is provided in such a manner that it juts out into or over the groove aligned with the outlet. The separating member is composed of a material which has predetermined lateral and longitudinal dimensions and also certain flexibility; the separating member is capable of securely retaining a medication thereon. Furthermore, since the separating member has certain flexibility, it does not scratch medications even if the medications bump against it, and it also prevents a dispensing failure caused by the medications being caught.

16 Claims, 22 Drawing Sheets

MEDICATION FILLING APPARATUS

BACKGROUND OF THE INVENTION

1. Field of the Invention

The present invention relates to a medication filling apparatus for filling a container such as a vial or a bag with medications (the medications hereinafter mean tablets, capsules, pills, lozenges, and any other solid medications) in a quantity specified by a prescription at a hospital or the like.

2. Description of the Related Art

Conventionally, at a hospital or a pharmacy, medications prescribed by doctors are supplied to patients by using a medication feeding machine as disclosed, for example, in Japanese Examined Utility Model Publication No. 57-7660 (B65D83/04). More specifically, medications in a quantity specified by a prescription are dispensed one by one from a tablet case using a dispensing drum and the dispensed medications are collected by a hopper, a conveyor, etc., then packaged with packaging paper.

In this case, the side surface of the dispensing drum in the tablet case is provided with a plurality of vertical grooves, i.e. aligned holes, so that the medications such as tablets, capsules, pills, and lozenges are admitted from the tablet case to the grooves and aligned in a single line in each of the grooves. Under this condition, the dispensing drum is rotated to let the medications fall out of the groove when the groove is aligned with an outlet, i.e. a dropping hole.

The medications falling through the outlet are counted by a sensor; when the number of the dropped medications reaches a quantity specified by the prescription, the dispensing drum is stopped, thus filling a container with a predetermined quantity of medications.

In a configuration where a groove permits two medications to enter therein vertically, there is a danger that the two medications drop at the same time through the outlet. To prevent this from happening, a conventional apparatus is provided with a separator which juts out in the groove as disclosed in the aforesaid publication so as to allow only one medication to drop at a time.

The separator is made of a plate-shaped member such as sheet metal which is thin but resistant to deformation because it is used to separate the medications, e.g. two medications, which have been vertically aligned in the groove provided on the rotating dispensing drum and to let the medications drop one by one. Thus, when the groove is aligned with the outlet, the separator separates the single medication which is in the lowermost position, i.e. the one to drop, from the medication above it so that the lowermost medication is permitted to fall while the medication above it is prevented from falling.

The aforementioned tablet case, dispensing drum, etc. are usually composed of synthetic resin primarily to enhance safety, obviate complicated manufacture processes, and protect medications from being scratched. Further, medications include many capsules; therefore, when the dispensing drum is rotated, static electricity is generated from the friction between the rotating dispensing drum and the medications, or among the medications, or between the tablet case and the medications, thus electrifying the medications.

As described above, the conventional apparatus employs a hard thin plate-shaped material as the separating plate, presenting a problem in that the separating plate scratches or chips medications.

There has been another problem: depending on shape and size of medications, if the medications which have been vertically aligned and fed in the groove are shifted vertically at their contact point, the separating plate would be caught on the side surfaces of the medications, clogging the medications and preventing them from being dispensed. For this reason, a plurality of different types and mounting positions of the separating plates have been conventionally prepared or the mounting position has been made adjustable, so that the separating plate may be changed or adjusted in position to make the separating plate exactly positioned between the vertically aligned medications according to the type of medications placed in the tablet case. Thus, extremely cumbersome work has been required in the conventional apparatus.

There has been still another problem: if the medications in the tablet case are electrified, then the medications, which are generally extremely lightweight, stick to the inner surface of the tablet case or the dispensing drum. As a result, the medications do not fall even when the dispensing drum rotates.

Moreover, the conventional apparatus is designed so that the aforesaid outlet of the medications is always open and therefore the medications are sometimes over-dispensed due to the inertia force of the dispensing drum. The chance of such over-dispensing increases greatly especially when the rotational speed of the dispensing drum is increased to shorten the filling time.

In particular, outside air comes into the table case through the outlet at all times, leading to a problem in that the medications absorb humidity and deteriorate or degrade. There has been another problem in that medications accidentally drop through the outlet, which is kept open at all times, when the tablet case is detached or attached for filling it with medications or for cleaning it.

SUMMARY OF THE INVENTION

Accordingly, the present invention has been made with a view toward solving the problems with the prior art described above and it is an object of the present invention to provide a medication filling apparatus which enables various types of medications to be dropped and dispensed reliably, accurately, and smoothly while preventing medications from being damaged or from clogging.

To this end, according to a first aspect of the present invention, there is provided a medication filling apparatus which is equipped with a tablet case for holding medications, and a dispensing drum which rotates to let the medications drop out of an outlet from the tablet case so as to dispense them, comprising: a plurality of grooves which are formed vertically on the side surface of the dispensing drum, into which the medications are fed from the tablet case, and which let the medications drop when the grooves are aligned with the outlet; and a separating member which is installed to jut out in or over the grooves aligned with the outlet, the separating member having predetermined lateral and longitudinal dimensions and having certain flexibility.

With this arrangement, a medication placed on the separating member can be adequately retained; in addition, since the separating member has certain flexibility, the medications will not be scratched even if they bump against the separating member. The problem of the medications being unable to be dispensed due to clogging, which causes an abnormal stop, will be also solved.

Even if the type of medications placed in the tablet case is changed and the size and shape of medications accordingly change to cause the separating position of the individual medications in the groove to be shifted and the separating member to be positioned on the side surface of the upper medication, the separating member will resiliently move outward to retain the upper medication in the groove of the dispensing drum since the separating member has certain flexibility and predetermined lateral and longitudinal dimensions.

Thus, the medications can be reliably dropped one by one even in such a case as described above; therefore, it is no longer necessary to make fine adjustment of the separating plate according to the size of medications as in the case of the conventional separating plate. Moreover, the versatility is enhanced with a resultant decreased number of different components involved and markedly improved assemblability.

According to a second aspect of the present invention, there is provided a medication filling apparatus which is equipped with a tablet case for holding medications, and a dispensing drum which rotates to let the medications drop out of an outlet from the tablet case so as to dispense them, comprising: a plurality of grooves which are formed vertically on the side surface of the dispensing drum, into which the medications are fed from the tablet case, and which let the medications drop when the grooves are aligned with the outlet; and a separating member which is installed to jut out in or over the grooves aligned with the outlet, the separating member being composed of a material which exhibits certain flexibility in the direction of the radius of the dispensing drum.

With this arrangement, a medication placed on the separating member can be adequately retained; in addition, the medications will not be scratched even if they bump against the separating member. The problem of the medications being unable to be dispensed due to clogging, which causes an abnormal stop, will be also solved.

Even if the type of medications placed in the tablet case is changed and the size and shape of medications accordingly change, causing the individual medications in the groove to be dislocated and the separating member to be positioned on the side surface of the upper medication, the separating member will resiliently move outward to retain the upper medication in the groove of the dispensing drum since the separating member has certain flexibility in the direction of the radius of the dispensing drum.

Thus, the medications can be reliably dropped one by one even in such a case as described above; therefore, it is no longer necessary to make fine adjustment of the separating plate according to the size of medications as in the case of the conventional separating plate. Moreover, the versatility is enhanced with a resultant decreased number of different components and markedly improved assemblability.

According to a third aspect of the present invention, there is provided a medication filling apparatus which is equipped with a tablet case for holding medications, and a dispensing drum which rotates to let the medications drop out of an outlet from the tablet case so as to dispense them, comprising: a plurality of grooves which are formed vertically on the side surface of the dispensing drum, into which the medications are fed from the tablet case, and which let the medications drop when the grooves are aligned with the outlet; and a brush member which is installed to jut out in or over the grooves aligned with the outlet.

With this arrangement, a medication placed on the brush member can be adequately retained; in addition, the medications will not be scratched even if they bump against the brush member. The problem of the medications being unable to be dispensed due to clogging, which causes an abnormal stop, will be also solved.

Even if the type of medications placed in the tablet case is changed and the size and shape of medications accordingly change, causing the individual medications in the groove to be dislocated and the brush member to be positioned on the side surface of the top medication, the brush member will resiliently move outward to retain the upper medication in the groove of the dispensing drum since the brush member has certain flexibility and predetermined lateral and longitudinal dimensions.

Thus, the medications can be reliably dropped one by one even in such a case as described above; therefore, it is no longer necessary to make fine adjustment of the separating plate according to the size of medications as in the case of the conventional separating plate. Moreover, the versatility is enhanced with a resultant decreased number of different components and markedly improved assemblability.

The medication filling apparatus in accordance with the present invention is further equipped with a conductive member which is provided in a portion other than the outlet and which is located below the grooves within a range where the respective grooves move, the conductive member being grounded.

This arrangement enables the static electricity to be removed from at least the medications which have been fed into the grooves. Hence, it is possible to prevent the medications from being stuck to the grooves of the dispensing drum, thereby permitting smooth dispensing of the medications.

Furthermore, the medication filling apparatus in accordance with the present invention has the separating member or the brush member which is composed of a conductive member and which is grounded, in addition to the arrangement described in the first, second, or third aspect of the present invention.

This arrangement also enables the static electricity to be removed from at least the medications which have been fed into the grooves. Hence, it is possible to prevent the medications from being stuck to the grooves of the dispensing drum, thereby permitting smooth dispensing of the medications.

Furthermore, the medication filling apparatus in accordance with the present invention has a conductive member which is provided on the inner wall of the tablet case and which is grounded, in addition to the arrangement described in the first, second, or third aspect of the present invention.

This arrangement enables the static electricity to be removed from the medications placed in the tablet. Hence, it is possible to prevent the medications from being stuck to the inner wall of the tablet case, thereby permitting smooth dispensing of the medications.

Further, the medication filling apparatus in accordance with the present invention is provided with shielding means which normally closes the outlet and opens it only when the dispensing drum is rotated to dispense medications, in addition to the arrangement described in the first, second, or third aspect of the present invention.

This arrangement blocks outside air from entering the tablet case through the outlet most of the time, thus solving the problem in that medications absorb humidity and deteriorate or degrade. The arrangement also prevents medications from accidentally dropping out of the outlet when the tablet case is detached or attached for supplying medications or for cleaning.

The outlet is closed when the dispensing operation is stopped; therefore, over-dispensing can be securely prevented, enabling accurate filling operation to be achieved.

The medication filling apparatus in accordance with the present invention is further provided with: shielding means which opens and closes the outlet and normally closes the outlet; and driving means which is normally spaced away from the shielding means but it comes in contact with the shielding means by a centrifugal force produced by the rotating dispensing drum so as to open the outlet, in addition to the arrangement described in the first, second, or third aspect of the present invention.

Further, in addition to the arrangement described in the first, second, or third aspect of the present invention, the medication filling apparatus in accordance with the present invention is further provided with: a shielding plate which is located below the bottom of the grooves and which rotates to open or close the outlet; a first spring which urges the shielding plate in the direction for closing the outlet at all times; a centrifugal arm which is rotatably provided in the dispensing drum and which is held against the shielding plate so that it may move away from the shielding plate or come in contact therewith; and a second spring which urges the centrifugal arm in the direction for moving it away from the shielding plate; wherein the centrifugal arm is usually away from the shielding plate due to the second spring, the shielding plate closes the outlet due to the first spring, and the centrifugal force produced by the rotation of the dispensing drum causes the centrifugal arm to move against the second spring so as to come in contact with the shielding plate. This in turn causes the shielding plate to turn against the first spring, thereby opening the outlet.

With this arrangement, the outlet can be opened or closed by the shielding means, i.e. the shielding plate, due to the centrifugal force generated by the rotation of the dispensing means, i.e. the dispensing drum; therefore, it is no longer required to provide a special electric driver for opening and closing the outlet. This permits reduction in production cost and also contributes to energy saving.

Moreover, since the shielding means, namely, the shielding plate, closes the outlet the moment the dispensing means, namely, the dispensing drum, stops, over-dispensing can be prevented even when the rotational speed of the dispensing means, namely, the dispensing drum, is increased. This permits shorter time required for dispensing and filling.

Further, the medication filling apparatus in accordance with the present invention has a shielding plate which is composed of a conductive material and which is grounded, in addition to the arrangement described above.

This arrangement removes the static electricity from the medications in the tablet case so as to enable smooth dispensing and charging of medications. Furthermore, the use of the shielding plate to remove the static electricity makes it possible to achieve reduced material cost and improved assemblability.

DESCRIPTION OF THE PREFERRED EMBODIMENTS

Figure 1:
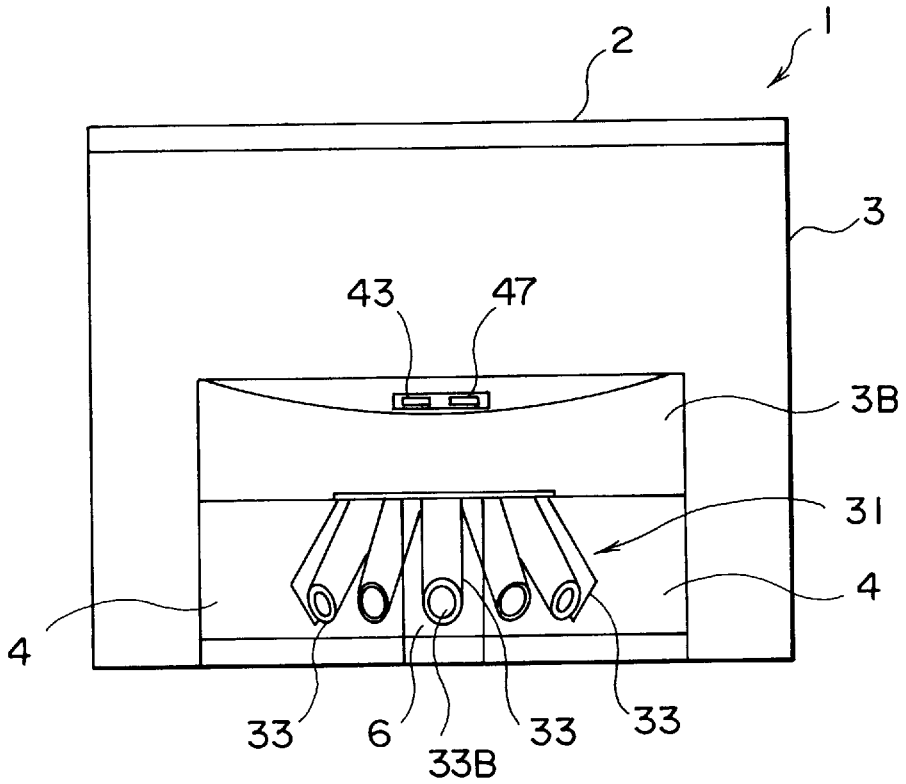
FIG. 1 is a front view showing a medication filling apparatus in accordance with the present invention.
Figure 2:
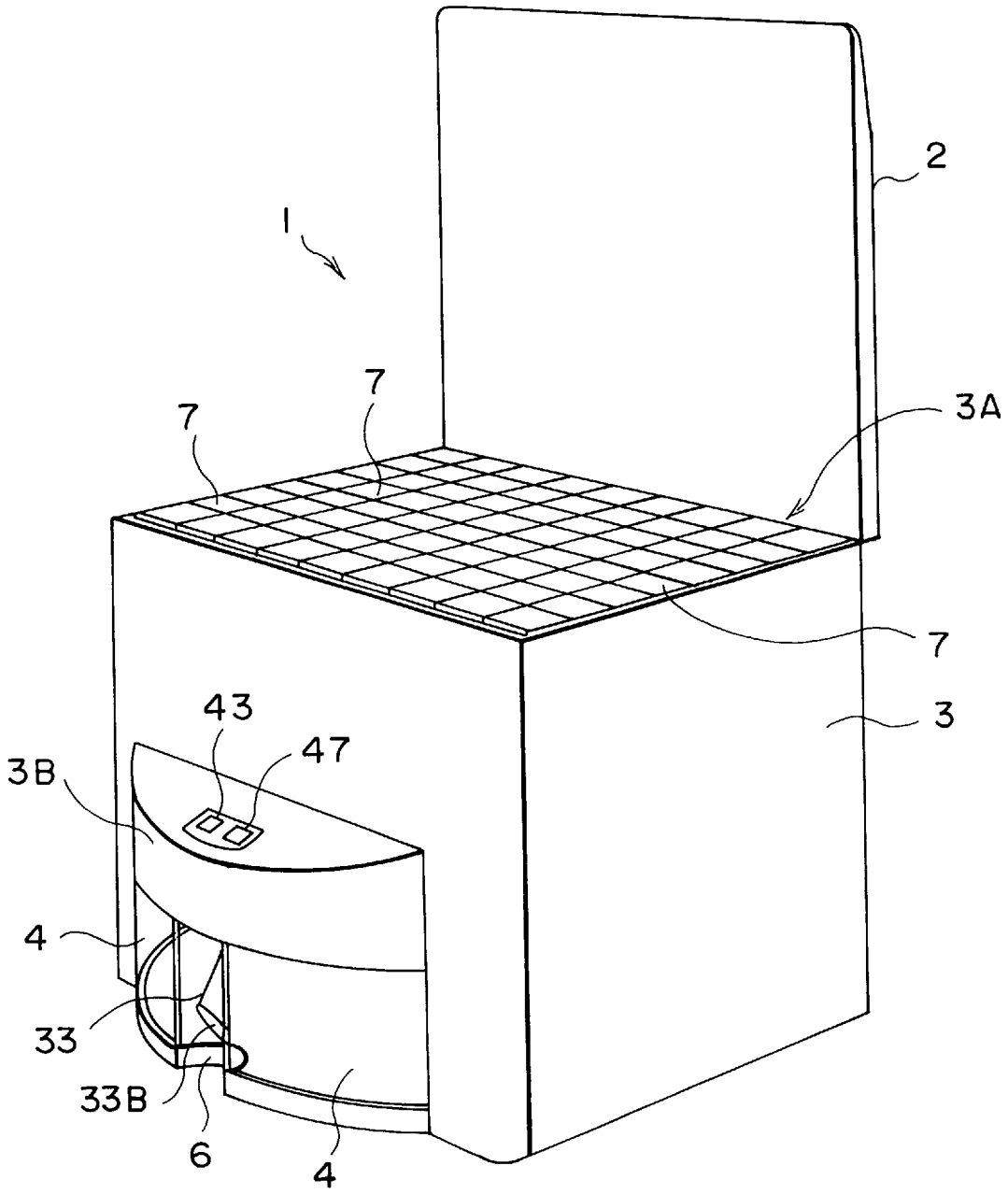
FIG. 2 is a perspective view showing the medication filling apparatus in accordance with the present invention with a top table thereof opened.
Figure 3:
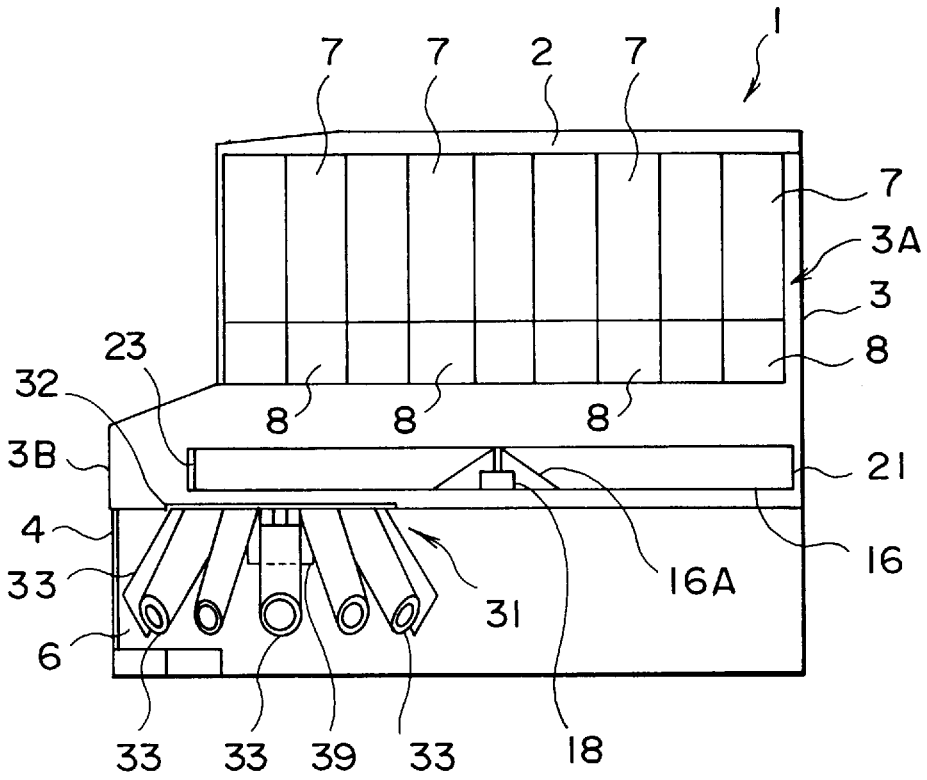
FIG. 3 is a longitudinal side view showing the medication filling apparatus in accordance with the present invention.
Figure 4:
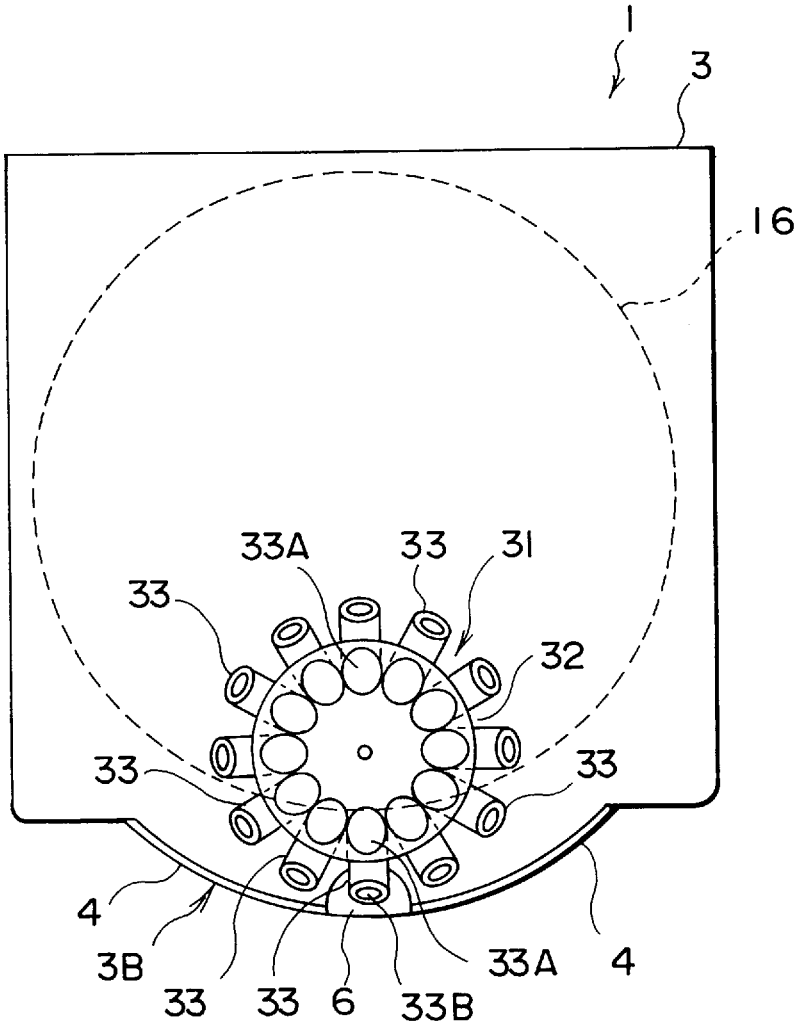
FIG. 4 is a top sectional view showing the medication filling apparatus in accordance with the present invention.

The present invention will be described in more detail in conjunction with the accompanying drawings.

A medication filling apparatus 1 according to the present invention is installed at a hospital, pharmacy, or the like. A tablet case enclosure 3A is disposed at the top inside a rectangular outer case 3; the tablet case enclosure 3A is open upward and provided with a top table 2 which opens and closes the tablet case enclosure 3A. A filling section 3B, which has an arcuate cross section, is provided on the front surface of the outer case 3. Transparent glass panels (or acrylic panels or the like) 4, 4 having arcuate cross sections are installed on both sides on the front surface of the filling section 3B and an inserting opening 6 which is communication with the filling section 3B is provided between the transparent panels 4, 4.

A plurality of tablet cases 7 are detachably disposed and housed in the tablet case enclosure 3A. The respective tablet cases 7 are filled with different types of medications 5 such as capsules which are shaped like cylinders with predetermined lengths and both ends of which are hemispherical. The inner surface of each of the tablet cases 7 is provided with a case grounding plate 26 which serves as a conductive member and which is disposed vertically on the inner surface.

The case grounding plate 26 functions to remove static electricity from the medication 5 or tablet case 7; it is composed of a conductive sheet metal such as copper or stainless steel. A conductive wire 26A is connected in the vicinity of the opening of the tablet case 7; the conductive wire 26A is grounded via a power earth, not shown, so as to remove the static electricity from the tablet case 7 itself or the medication 5 which has been in contact with the case grounding plate 26.

Provided beneath the respective tablet cases 7 are corresponding dispensing & counting devices 8.

Figure 8:
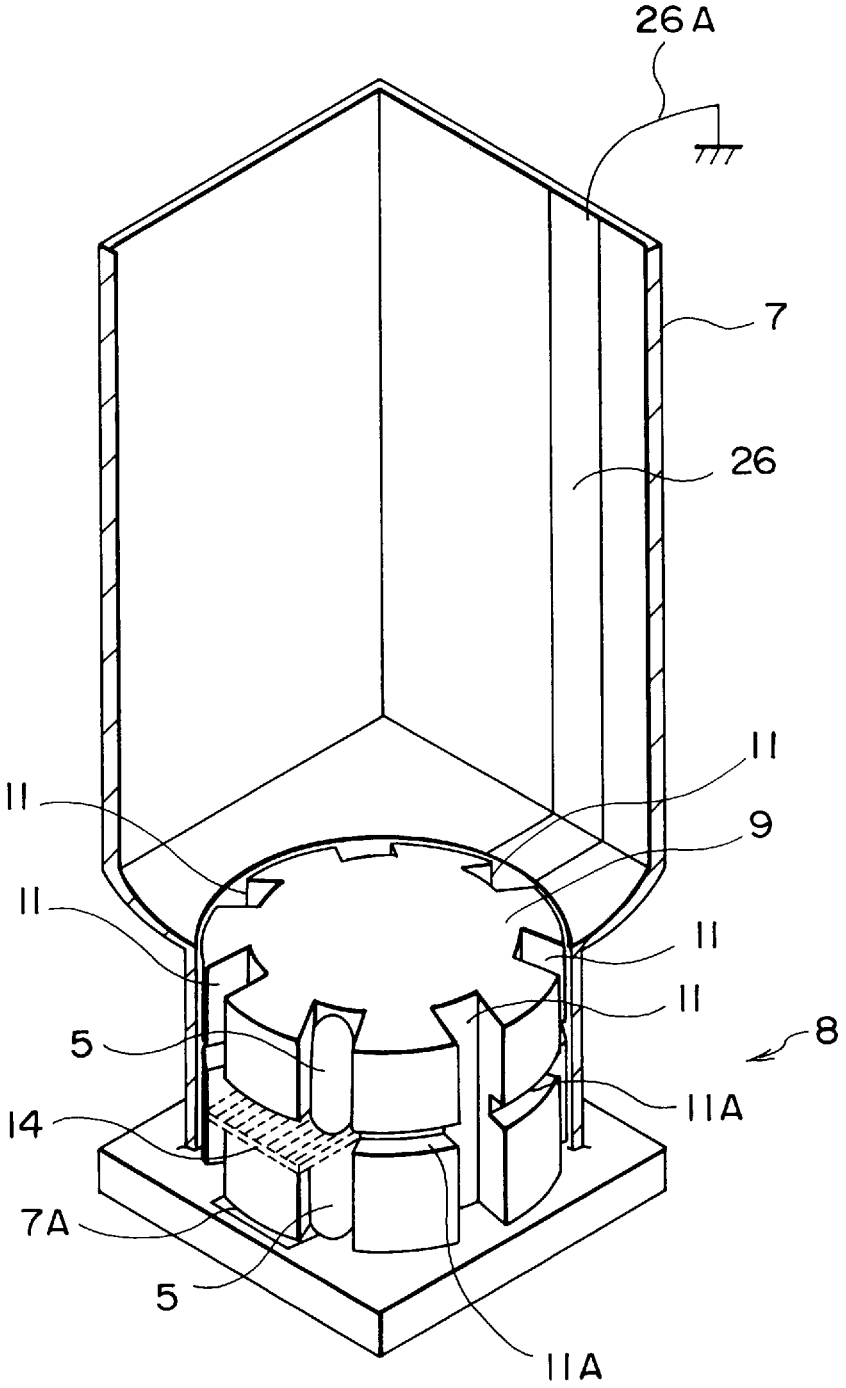
FIG. 8 is a partially cut away perspective view showing the interior of a tablet case equipped with a case grounding plate.
Figure 9:
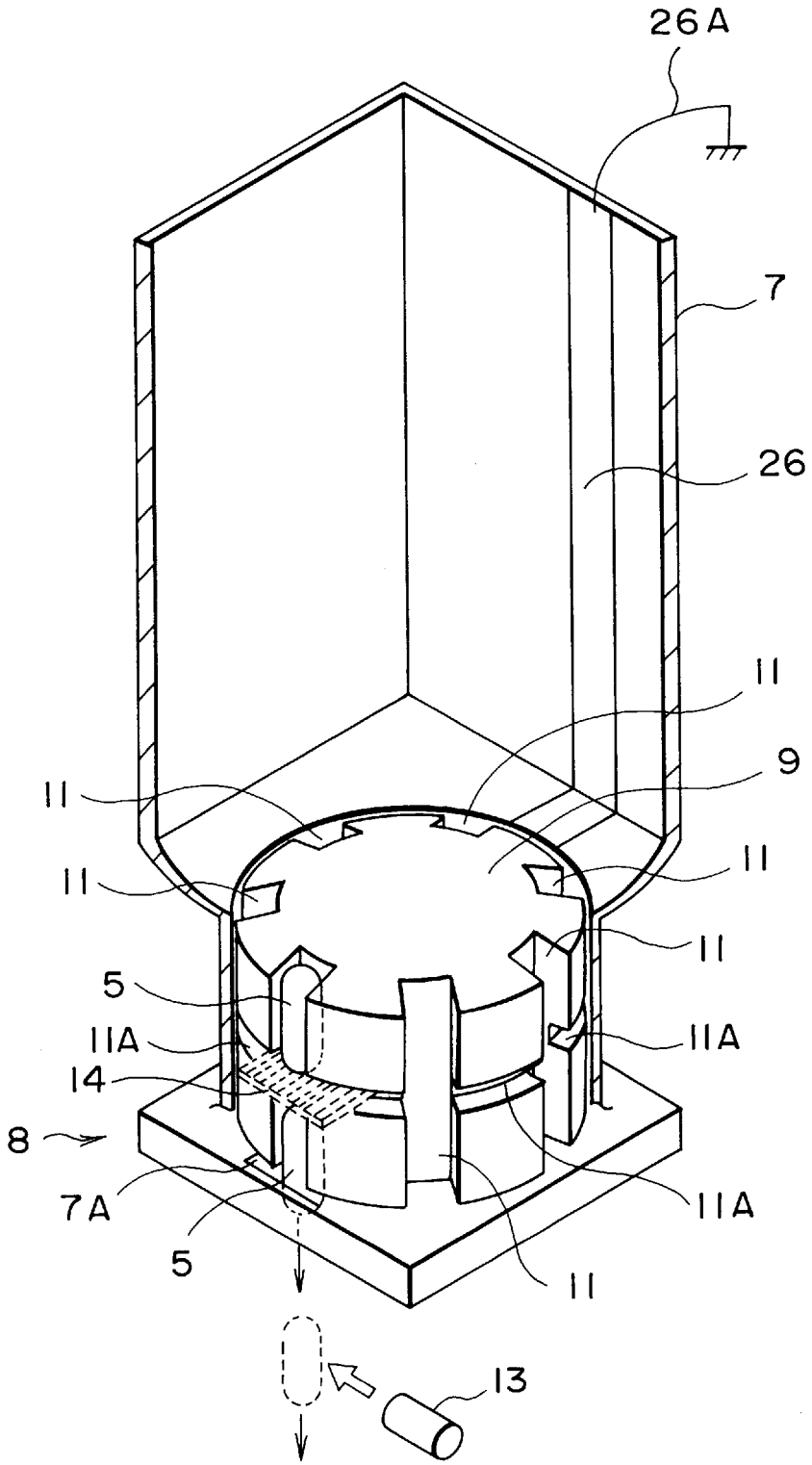
FIG. 9 is another partially cut away perspective view showing the interior of a tablet case equipped with a case grounding plate.
Figure 10:
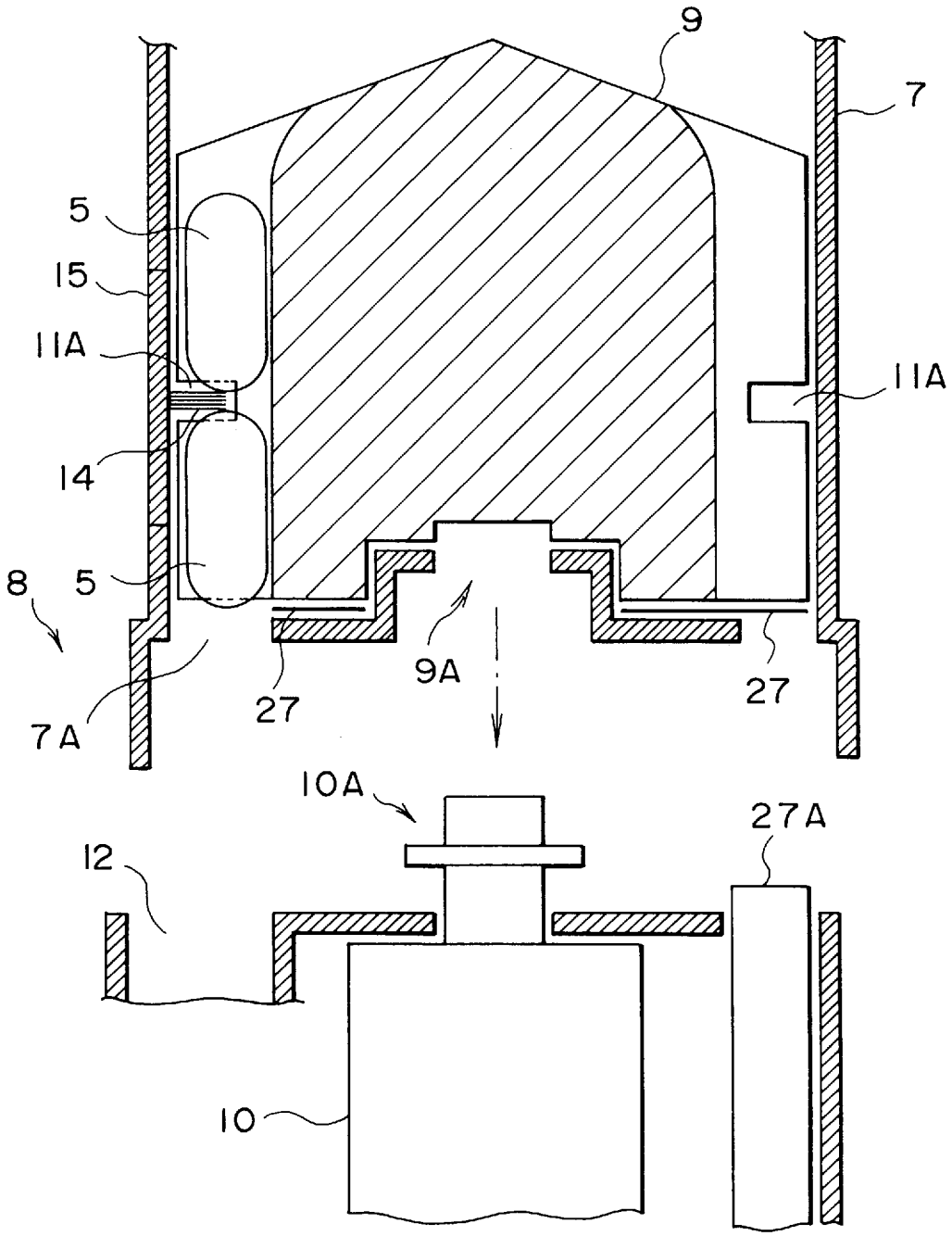
FIG. 10 is a longitudinal side view showing the bottom of the tablet case shown in FIG. 8.

As shown in FIG. 8 through FIG. 10, the dispensing & counting device 8 is comprised primarily of a dispensing drum 9 and a brush member 14 which are provided on the tablet case 7 side and a drum rotating motor 10 for driving the dispensing drum 9 and a photosensor 13 which are provided on the main body, i.e. the outer case 3. The dispensing drum 9 is incorporated at the bottom inside the tablet case 7; the side surface thereof is provided with a plurality of vertical grooves 11 into which the medications 5 such as tablets, capsules, pills, and lozenges are fed vertically in alignment, two pieces in this embodiment.

Formed around the side surface, excluding the grooves 11, of the dispensing drum 9 are separating grooves 11A of a predetermined depth which are provided at predetermined distance from the bottom end, the distance being equivalent to the size of one medication 5. The tablet case 7 and the dispensing drum 9 are composed of ABS resin or other hard synthetic resin or the like. The grooves 11 provided on the side surface of the incorporated dispensing drum 9 are formed integrally with the dispensing drum 9.

As shown in FIG. 10, the bottom surface of the dispensing drum 9 is provided with a fitting section 9A; a drum grounding plate 27 serving as a conductive member is disposed between the bottom surface of the dispensing drum 9 excluding the portion of the fitting section 9A and the bottom surface of the tablet case 7. The drum grounding plate 27 functions to remove the static electricity at least from the medications 5 which have been fed in the groove 11, the tablet case 7, and the dispensing drum 9; it is also composed of a conductive sheet metal plate of copper, stainless steel, etc.

The drum grounding plate 27 is annularly shaped as a whole; the portion corresponds to the outlet 7A has been cut off. The drum grounding plate 27 is mounted under the dispensing drum 9 (in this embodiment, it is provided under the grooves 11 in the moving range of the respective grooves 11 excluding the outlet 7A); it is in contact with a drum grounding plate receiver 27A which is provided on the main body side beneath the tablet case 7 so as to be connected to the power earth which is not shown.

A drum rotating motor 10 is provided on the main body side to match the bottom of the dispensing drum 9. A fitting shaft, i.e. a rotary shaft, 10A juts out from the top surface of the drum rotating motor 10; the fitting shaft 10A fits in the fitting section 9A of the dispensing drum 9. When the tablet case 7 is mounted, the fitting section 9A of the dispensing drum 9 fits onto the fitting shaft 10A of the drum rotating motor 10 and the drum grounding plate 27 is brought in contact with the grounding plate receiver 27A.

The bottom surface of the tablet case 7 has the outlet 7A which is formed in a position in the rotating range of the grooves 11. A path 12 which is open on a turntable 16, which will be discussed later, is provided on the main body side to match the outlet 7A. As the dispensing drum 9 is driven by the drum rotating motor 10, the medication 5 in the groove 11 which is aligned with the outlet 7A is dropped into the path 12 through the outlet 7A as indicated by a black arrow in FIG. 5.

Figure 11:
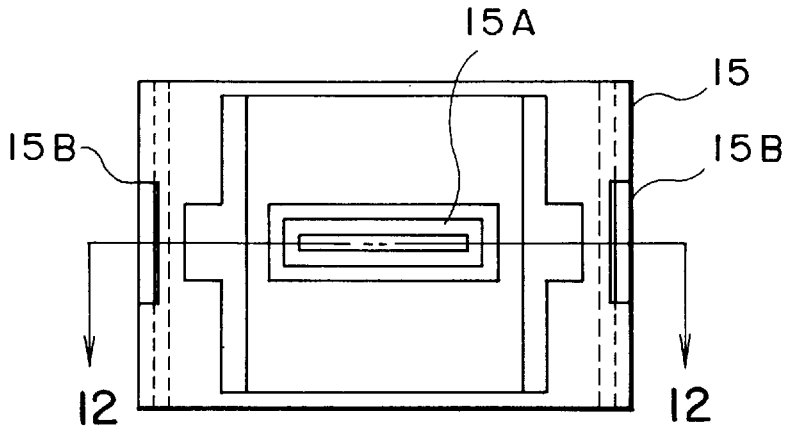
FIG. 11 is a front view of a cover.
Figure 12:
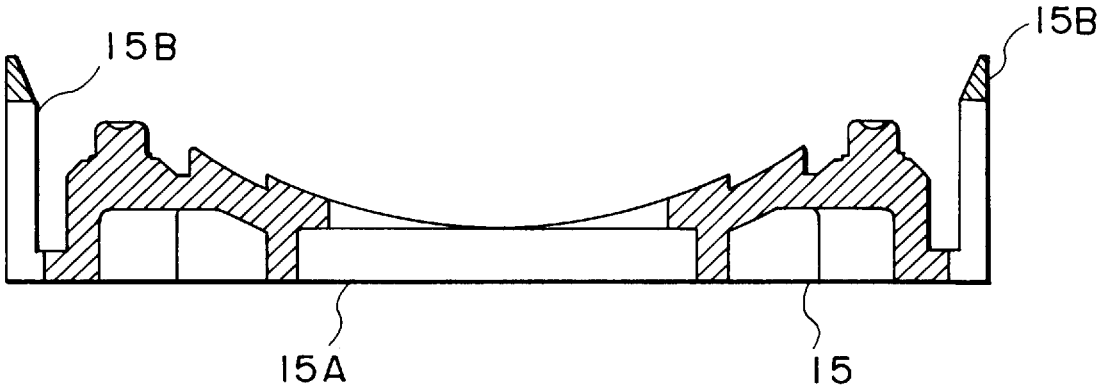
FIG. 12 is a sectional view taken on line 12—12 shown in FIG. 11.
Figure 13:
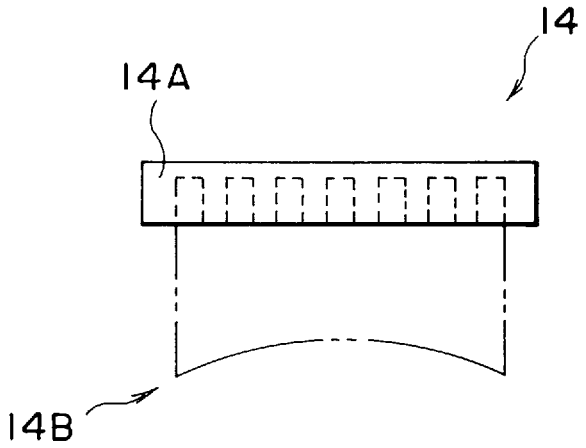
FIG. 13 is a top plan view showing a brush member.
Figure 14:
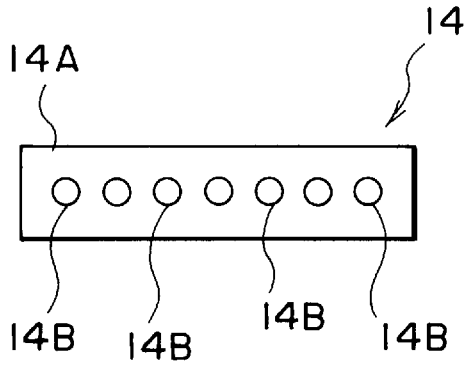
FIG. 14 is a front view showing the brush member.

Detachably installed on the side surface of the tablet case 7 above the outlet 7A is a cover 15 as shown in FIG. 11 and FIG. 12; the brush member 14 serving as the separating member composed of a conductive material is attached to the cover. The brush member 14 provides a vertical separator in the groove 11 so as to securely let the medications 5 in the groove drop one at a time through the outlet 7A. As shown in FIG. 13 and FIG. 14, the brush member 14 employs filament fiber 14B composed by a mixture of flexible fiber, i.e. chemical fiber such as nylon, or natural fiber such as animal hair and a conductive material such as carbon. The fiber 14B is implanted at a predetermined density in a fixed plate 14A like a toothbrush having predetermined lateral and longitudinal dimensions.

The distal edge of the fiber 14B is trimmed arcuately so that it comes close to or in contact with the bottom surface of the separating grooves 11A of the dispensing drum 9 (see FIG. 13 and FIG. 14). A conductive wire, not shown, is connected to the fiber 14B to ground it via the power earth, thereby removing static electricity from the dispensing drum 9 or the medications 5 in the grooves 11.

The cover 15 installs the brush member 14 in a predetermined position on the dispensing drum 9 in a detachable fashion. As shown in FIG. 11 and FIG. 12, a fitting section 15A for fitting a fixing plate 14A of the brush member 14 is formed approximately at the center of the cover 15. Hooks 15B, 15B which engage with the tablet case 7 are provided on both sides of the cover 15; fixing the cover 15 on the tablet case 7 detachably installs the brush member 14 on the side of the dispensing drum 9.

In the state described above, the fiber 14B goes into the separating groove 11A to vertically separate the interior of the groove 11; it positions itself between the lowermost medication 5 and the medication 5 thereover which have been fed into the groove 11 in alignment. The photosensor 13 is installed in a position for detecting the medications 5 which fall out through the outlet 7A.

Figure 5:
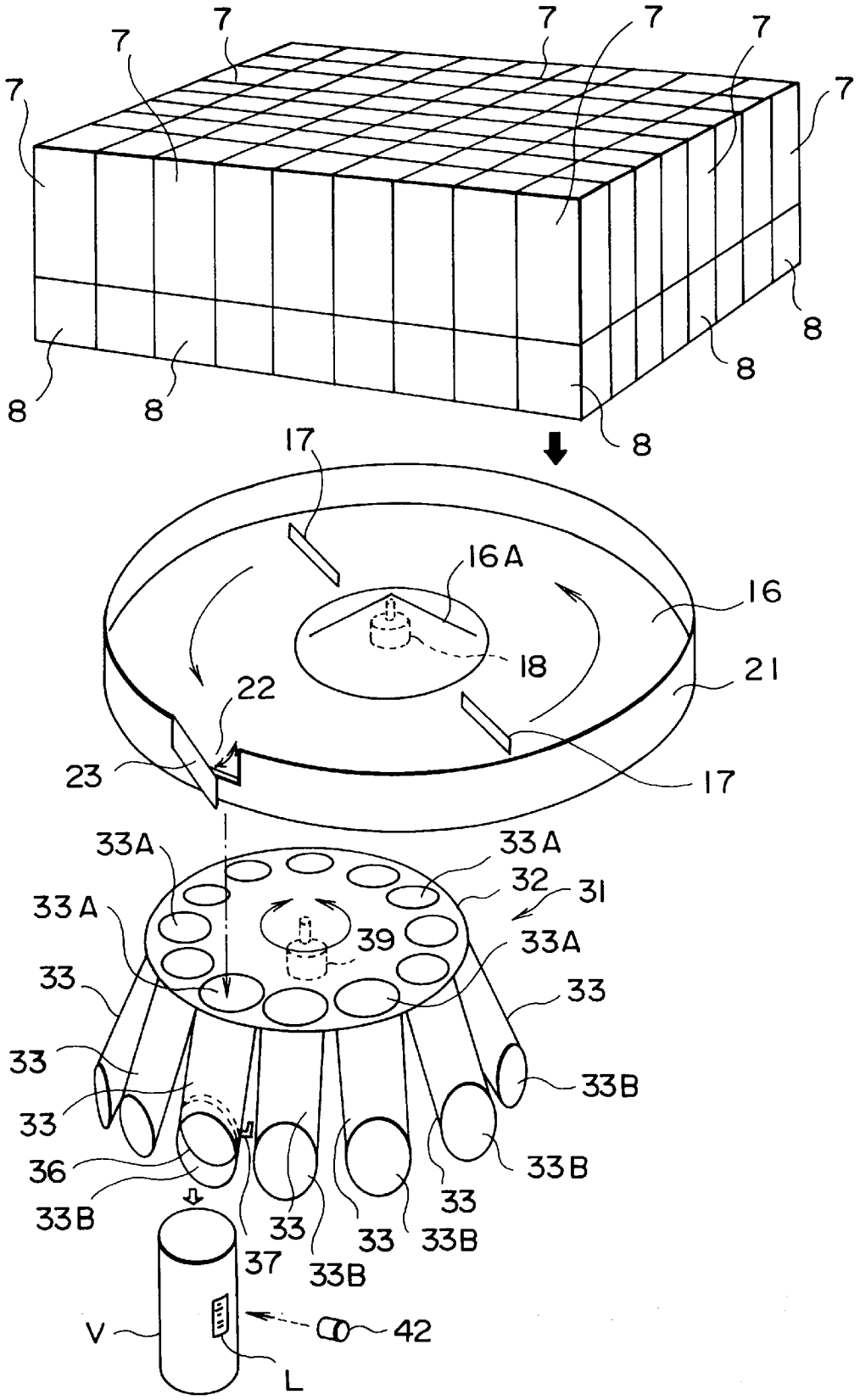
FIG. 5 is an illustration of the internal configuration of the medication filling apparatus in accordance with the present invention.

The turntable 16 is provided in the main body, i.e. the outer case 3, under the tablet case 7 and the dispensing & counting device 8; the turntable 16 is shaped like a disc and has a sufficiently large area to match the bottom area of all the tablet cases 7 and the dispensing & counting devices 8. The turntable 16 has a projection cone 16A at the center thereof; there are also provided separating vanes 17, 17 which extend in the radial direction from the projecting cone 16A (FIG. 5). A turntable motor 18 provided beneath the projecting cone 16A drives and rotates the turntable 16 in the direction of the arrows shown in the drawing at a predetermined speed.

An annular guide 21 is provided vertically around the turntable 16; a notch-shaped dispensing port 22 is formed at the front end of the guide 21. The dispensing port 22 communicates the turntable 16 with the area outside the guide 21. The dispensing port 22 is opened and closed by a shutter 23 which swings outward. The shutter 23 is driven by a shutter activating means 24 of a solenoid plunger or the like, which will be discussed later. The vertical dimension of the turntable 16 including the guide 21 is approximately 10 cm.

Figure 6:
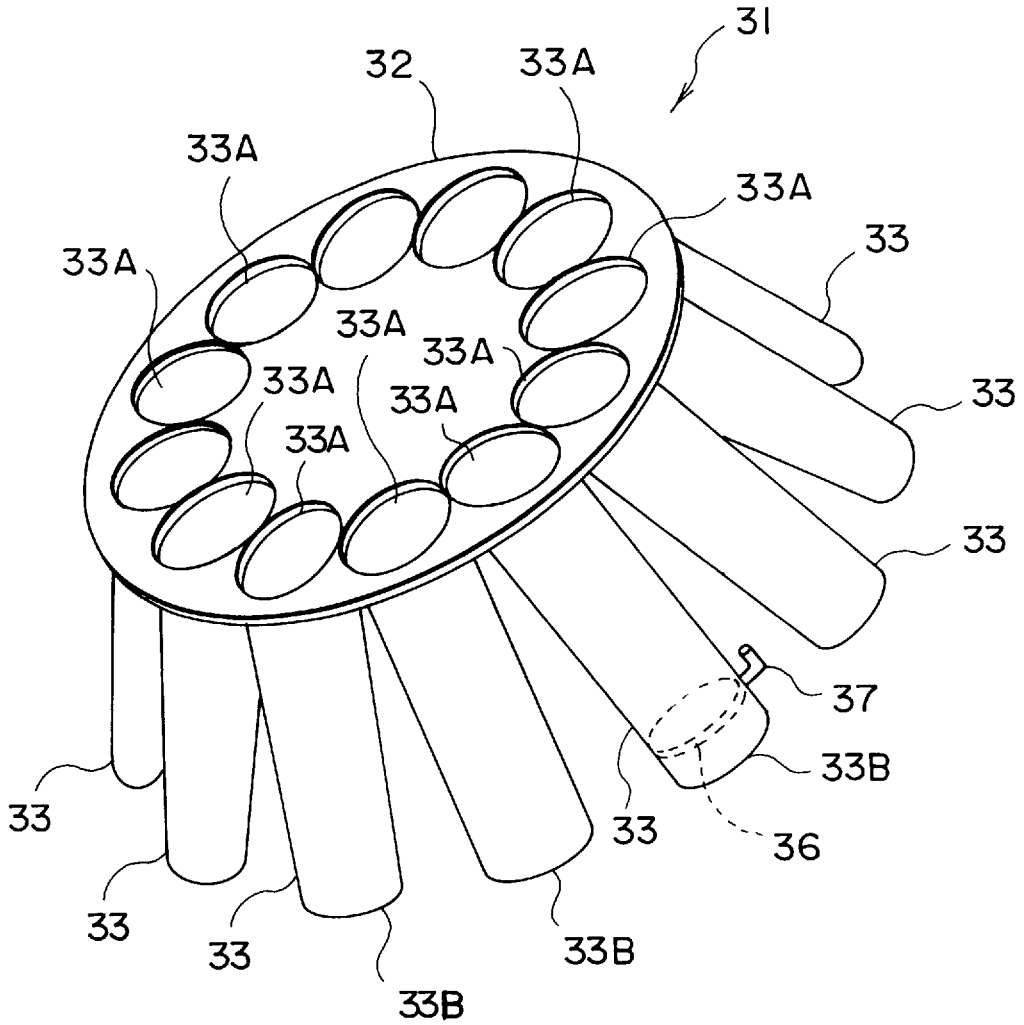
FIG. 6 is a perspective view illustrating a holder unit.
Figure 7:
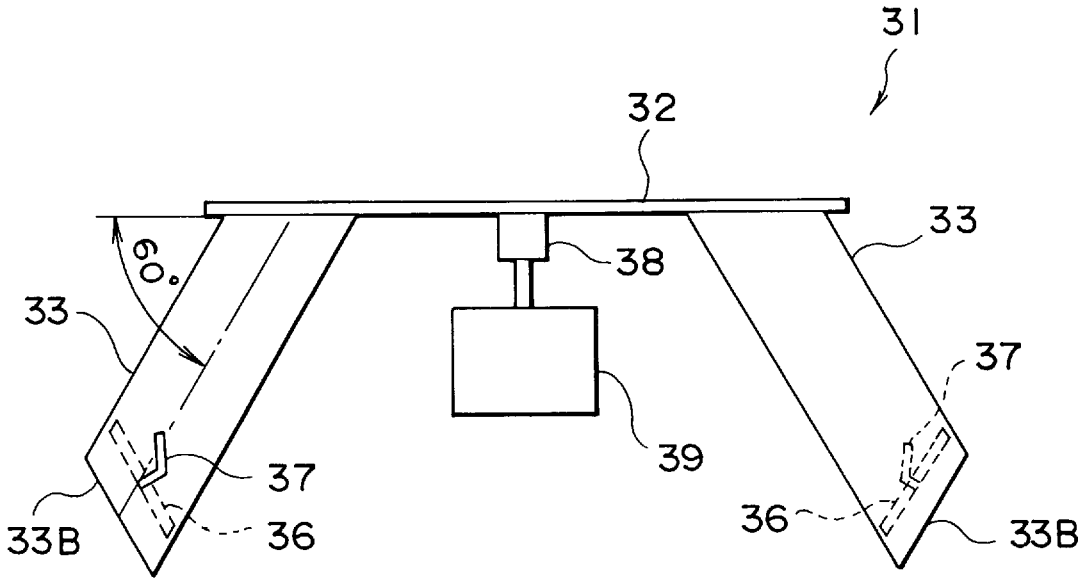
FIG. 7 is a side view of the holder unit.

Provided at the bottom front of the turntable 16 and the guide 21 is a holder unit 31 which temporarily retains the medications 5. As shown in FIG. 6 and FIG. 7, the holder unit 31 is equipped with a disc base 32 at the top and a plurality of holders 33 (12 holders in this embodiment) which jut out from the base 32 downward and outward aslant (at 60 degrees in the embodiment). The top ends of the respective holders 33 are open through inlets 33A provided in the base 32, while the bottom ends thereof are open through an outlets 33B.

Further, the respective holders 33 extend radially from the center of the base 32; the respective inlets 33A and the respective outlets 33B are arranged on virtual circles which are concentric with the base 32. The respective holders 33 are equipped with covers 36 for opening and closing the respective outlets 33B although only one cover is shown in FIG. 5 and FIG. 6; the covers 36 close the outlets 33B at all times by springs or the like which are not shown. Each cover 36 has a handle 37 sticking out of the holder 33 and the cover 36 is swung by the handle 37 to open the outlet 33B.

A rotary shaft 38 juts out downward from the center of the base 32 of the holder unit 31. A holder motor 39 is attached to the rotary shaft 38 and the holder unit 31 is driven and rotated by the holder motor 39. The holder unit 31 is equipped with a holder position sensor 41 for detecting the positions of the respective holders 33, which will be discussed hereinafter.

Inside the filling section 3B of the aforesaid outer case 3, there is provided a bar code reader 42 which is located near the inserting opening 6. Provided on the top surface of the filling section 3B are a key switch 43 consisting of ten keys and a display 47 for showing prescription data and preparing state and for giving an alarm.

Figure 18:
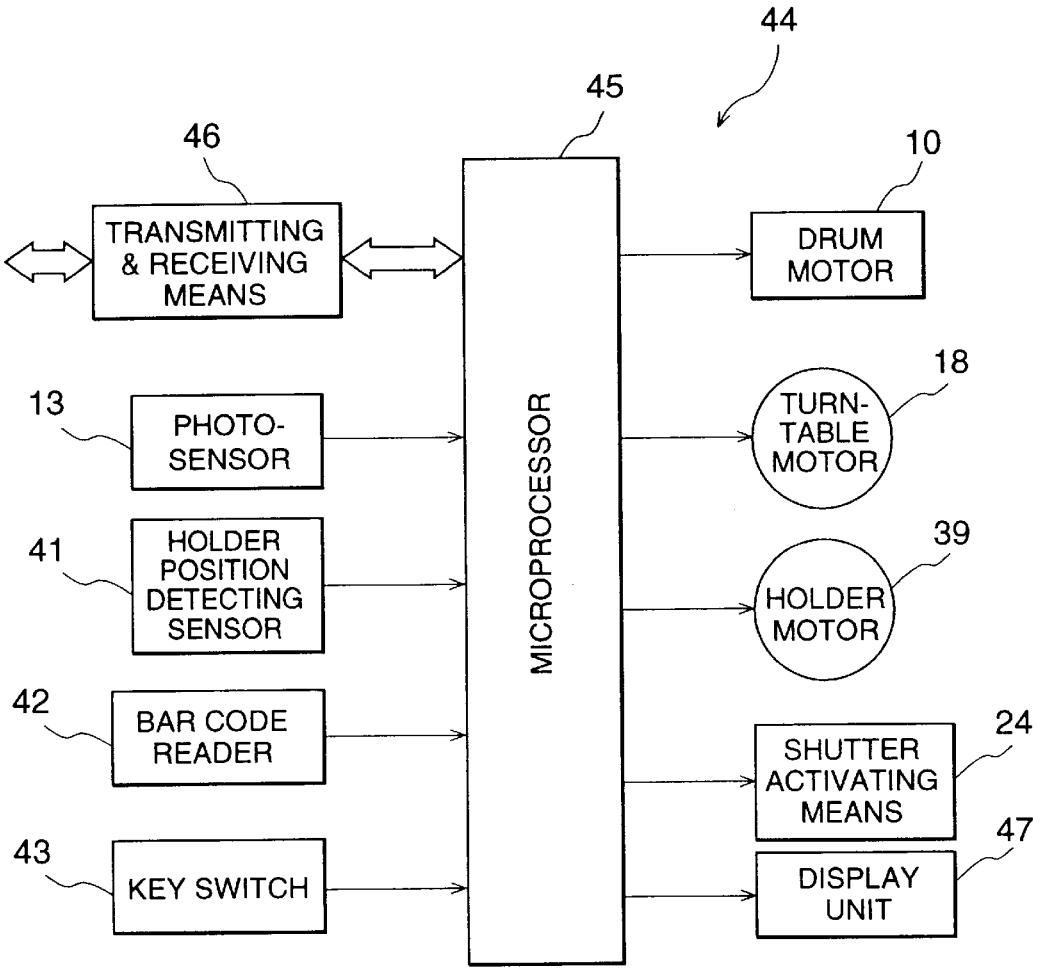
FIG. 18 is a block diagram showing a control unit of the medication filling apparatus in accordance with the present invention.

FIG. 18 is the block diagram showing a control unit 44 of the medication filling apparatus 1 in accordance with the present invention. The control unit 44 is comprised of a general-purpose microprocessor 45. Connected to the microprocessor 45 is a transmitting and receiving means 46 for exchanging data with an external personal computer, which is not shown; connected to the input terminal thereof are the photosensors 13 of the dispensing & counting devices 8, the holder position detecting sensor 41 of the holder unit 31, the bar code reader 42, and the key switch 43.

Connected to the output terminal of the microprocessor 45 are the drum rotating motor 10 for driving the dispensing drum 9, the turntable motor 18, the holder motor 9, the shutter activating means 24, and the display unit 47.

Figure 19:
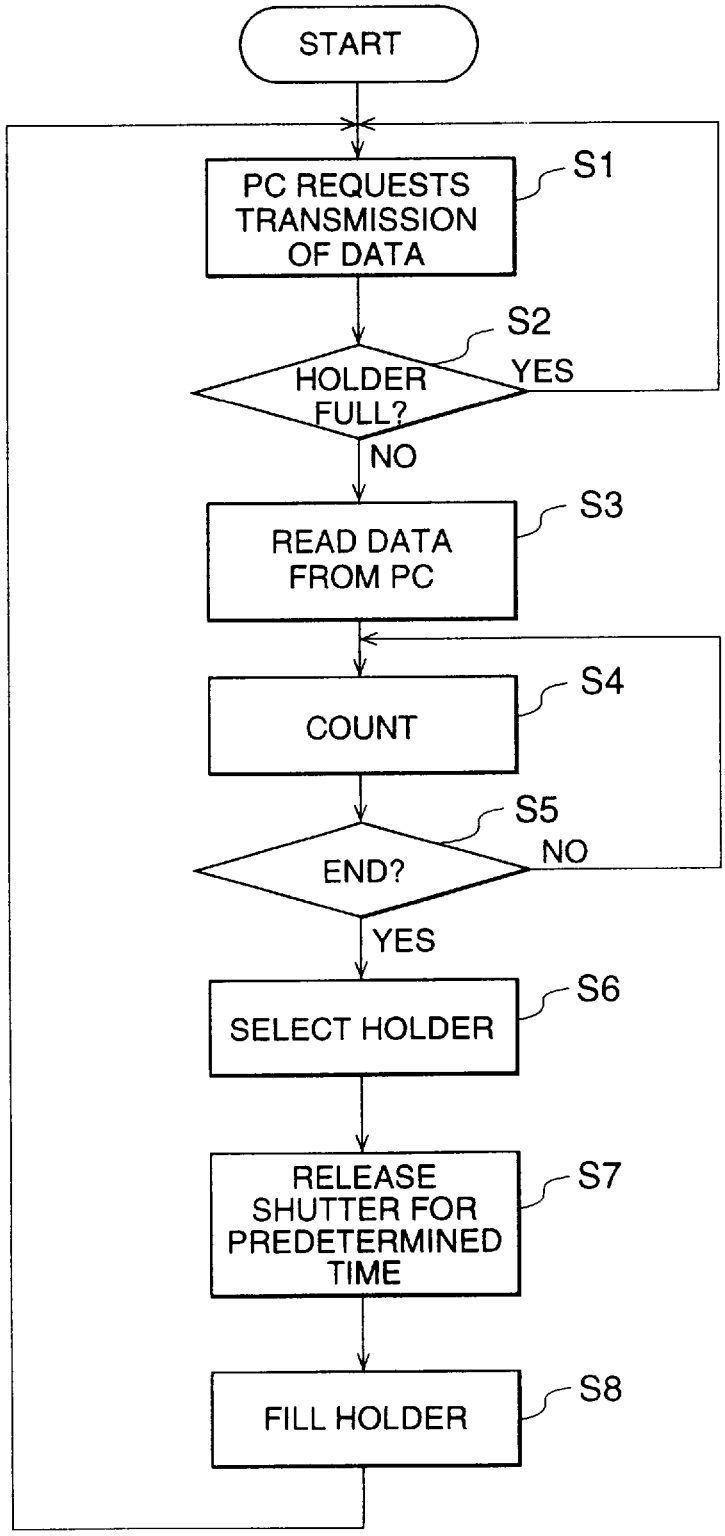
FIG. 19 is a flowchart showing a program of a microprocessor.
Figure 20:
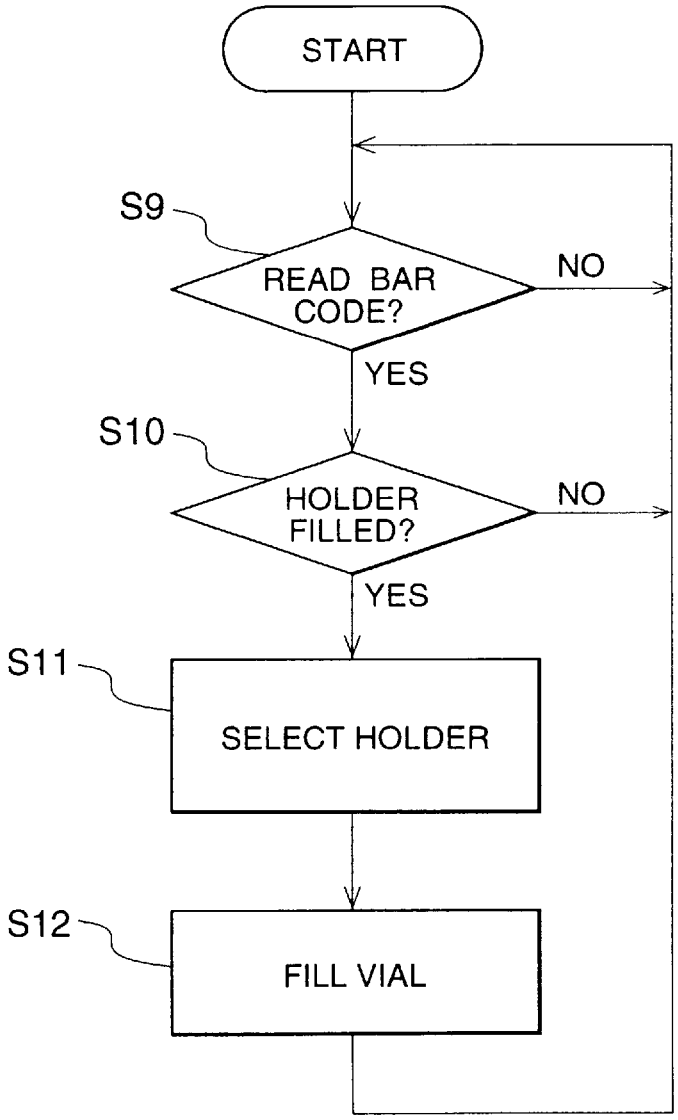
FIG. 20 is another flowchart showing the program of the microprocessor.

Now that the configuration has been described, the operation of the medication filling apparatus 1 in accordance with the present invention will be described. FIG. 19 shows the flowchart of the program for the medication dispensing operation performed by the microprocessor 45; FIG. 20 gives the flowchart of the program for the medication filling operation performed by the microprocessor 45.

With the power is ON, the shutter 23 closes the dispensing port 22 of the guide 21 and all count values are reset. The turntable motor 18 is energized at all times so that the turntable 16 turns at all times. It is also possible to halt the turntable 16 temporarily when the preparing operation is halted for a predetermined time.

When an operator keys in prescription data into the personal computer according to a prescription given by a doctor, the personal computer requests the transmission of data from the medication filling apparatus 1. As soon as the microprocessor 45 of the medication filling apparatus 1 receives the request for the data transmission from the personal computer through the transmitting and receiving means 46 in step S1, it determines in step S2 whether all the holders 33 of the holder unit 31 retain and are full of medications; if it decides that they are full, then it goes back to step S1 wherein it stands by.

If the microprocessor decides in step S2 that the holders 33 are not filled up, then it responds, in step S3, to the personal computer, telling that it is ready to receive data and it receives and reads the prescription data sent from the personal computer. In step S4, based on the prescription data, the microprocessor 45 rotates the dispensing drum 9 by driving the drum rotating motor 10 of the dispensing & counting device 8 of the tablet case 7 for holding the type of medications 5 specified in the prescription data.

As the dispensing drum 9 rotates, the tablet cases 7, the dispensing drum 9, the medications 5, etc. are charged with static electricity. The static electricity, however, is removed from the medications 5 since the medications 5 come in contact with the case grounding plate 26 at the top of the tablet case 7, or the bottom ends of the medications 5 come in contact with the drum grounding plate 27 when they are in the grooves 11 in the rotating range thereof.

As the dispensing drum 9 rotates, the medications 5 fall from the groove 11 which is aligned with the outlet 7A; at this time, the brush member 14 is placed between the two medications 5, 5 vertically aligned in the groove, so that the brush member 14, which is in contact with the groove 11 and the medications 5, removes the static electricity therefrom while retaining the upper medication 5 at the same time. This allows only the lower medication 5 under the brush member 14 to drop from the groove 11 without sticking to the groove 11 due to static electricity. The medications 5 do not stick to the upper inner surface of the tablet case 7, either.

Thus, the medications 5 smoothly drop from the respective grooves 11 one by one as the dispensing drum 9 rotates. The arrangement described above also solves the problem with the conventional apparatus in that the generated static electricity causes the medications 5 to stick to the grooves 11 of the dispensing drum 9, preventing the medications 5 from being dispensed.

Since the brush member 14 is composed of the flexible filament fiber 14B which is implanted in the fixed plate 14A at the predetermined density in the form of a toothbrush having predetermined lateral and longitudinal dimensions, it is capable of securely holding the medication 5 thereon. In addition, since the brush member 14 has certain flexibility in the radial direction, i.e. outward, of the dispensing drum 9 and also in the vertical direction, even if the medications 5 bump against the brush member 14, the medications 5 will not be scratched and the medications will not be caught, either, thus preventing a dispensing failure which causes an abnormal stop.

When a different type of medications 5 are put in the tablet case 7 and the separating position of the medications, namely, the contact point between the two medications 5, 5, in the groove 11, is shifted because of the different size and/or shape of the medications 5 such as in a case where shorter capsules are charged in the tablet case 7, the brush member 14 will be positioned at the side surface of the upper medication 5; as previously described, the brush member 14 exhibits certain flexibility in the radial direction of the dispensing drum 9 and has the predetermined lateral and vertical dimensions, therefore, the fiber 14B of the brush member 14 resiliently moves outward, i.e. toward the tablet case 7 and it also securely retains the upper medication 5 between itself and the bottom surface of the groove 11 of the dispensing drum 9.

Accordingly, even in such a case, the medications 5 can be securely dropped one at a time and it is no longer necessary to make fine adjustment of the separating plate according to the size of the medications 5 as in the conventional apparatus. In addition, the enhanced versatility permits a reduced number of different components used and also enables improved assemblability.

Thus, the medications drop one by one as previously mentioned and the dropped medications are received by the turntable 16. The medications 5 that have dropped are counted by the microprocessor 45 according to the output received from the photosensor 13. In step S5, the microprocessor determines whether the counting has been completed; if the determination result is negative, then it goes back to step S4 to repeat the same process. When the number of dropped medications 5 detected by the photosensor 13 coincides with the number of the medications 5 based on the prescription data, the microprocessor 45 decides that the counting has been completed and it stops supplying electric currents to the drum rotating motor 10 before it advances from step S5 to step S6.

The medication 5 which has dropped onto the turntable 16 moves toward the guide 21 located on the circumference of the turntable 16 due to the centrifugal force of the rotating turntable 16. At this time, since the projecting cone 16A is located at the center of the turntable 16 at which the centrifugal force is weaker, the medication 5 dropped onto the center moves outward along the slope of the projecting cone 16A and then moves toward the guide 21 owing to the centrifugal force. The separating vanes 17, 17 provided on the turntable 16 turn with the turntable, so that the medication 5 which stays stationary on the turntable 16 is also pushed and moved outward smoothly. Thus the medications 5 dropped onto the turntable 16 are collected and moved to the guide 21 and aligned, being pushed against the guide 21.

Next, in step S6, the microprocessor 45 selects an empty holder 33, drives the holder motor 39 to rotate the holder unit 31, and positions the empty holder 33 under the dispensing port 22 of the guide 21 with the aid of the holder position detecting sensor 41. Then in step S7, the microprocessor 45 swings the shutter 23 outward as shown in FIG. 5 by the shutter activating means 24 to open the dispensing port 22 for a predetermined time (e.g. 1 second) and then close it.

When the dispensing port 22 is opened, the medications 5 aligned against the inner circumferential wall of the guide 21 are collected at the dispensing port 22 one after another by the centrifugal force and moved into the holder 33 through the inlet 33A of the holder 33 (step S8).

The microprocessor 45 repeats the procedure from step S4 to step S8 for all types of medications 5 specified by the prescription data to fill the separate holders 33 for the different types of medications.

The operator attaches a bar code label L, which carries the bar code indicating the name of a patient and/or one type of the medications specified by the prescription data, to the side face of a vial V serving as the predetermined container. When the container is inserted into the filling section 3B through the inserting opening 6 of the medication filling apparatus 1, the bar code on the bar code label L is read through the bar code reader 42. The microprocessor 45 determines in step S9 of FIG. 20 whether the bar code (the type of the medication 5) has been successfully read through the bar code reader 42; if it decides that the bar code has been read properly, then it proceeds to step S10 wherein it decides whether the holder 33 has been filled with the specified type of medications 5. If the microprocessor finds that the holder has not yet been filled, then it returns to step S9 wherein it stands by.

When the specified type of medications have been charged in the holder 33 in step S8, the microprocessor 45 advances from step S10 to step S11 wherein it selects the holder 33 filled with the medications 5, drives the holder motor 39 to rotate the holder unit 31, and positions the holder 33 at the inserting opening 6 with the aid of the holder position detecting sensor 41.

Under the condition stated above, the port of vial V is positioned under the outlet 33B of the holder 33 and the cover 36 is opened by the handle 37 to fill vial V with the specified type of medications 5 from the holder 33 (step S12).

Thus, according to the present invention, as the separating member for separating the medications 5, 5 in the groove 11, the brush member 14 is employed which is composed of the flexible filament fibers 14B implanted in the fixed plate 14A at the predetermined density in the form of a toothbrush having predetermined lateral and longitudinal dimensions; therefore, the medication 5 placed on the brush member 14 can be securely retained. Moreover, since the brush member 14 has certain flexibility in the radial direction, i.e. outward, of the dispensing drum 9 and also in the vertical direction, even if the medications 5 bump against the brush member 14, the medications 5 will not be scratched and the medications 5 will not be caught, either, thus preventing a dispensing failure which causes an abnormal stop.

Even when the type of medications is changed and the size and shape of medications accordingly change, the fiber 14B of the brush member 14 will resiliently move outward to retain the upper medication 5 between itself and the bottom surface of the groove 11 of the dispensing drum 9. Accordingly, the medications 5 can be reliably dropped one by one in such a case as described above; in addition, it is no longer necessary to make fine adjustment of the mounting position of the separating plate according to the size of medications 5 as in the case of the conventional separating plate. Moreover, the versatility is enhanced with a resultant markedly improved assemblability and a decreased number of different components involved.

The case grounding plate 26 is provided on the inner side surface of the tablet case 7 and the drum grounding plate 27 is installed between the bottom surface of the dispensing drum 9 and the tablet case 7; therefore, even if static electricity is generated as the dispensing drum 9 runs and the tablet case 7, the dispensing drum 9, and the medications 5 are electrified, the static electricity can be removed through the case grounding plate 26 and the drum grounding plate 27 via the conductive wire 26A and the drum grounding plate receiver 27A. Hence, the charges on the dispensing drum 9 or the medications 5 can be removed before they generate an abnormally high potential. This allows the medications 5 in the groove to fall smoothly, thus preventing the medications 5 from being stuck in the groove 11 and failing to fall.

Furthermore, since the conductive brush member 14 is attached to the side surface of the dispensing drum 9, even if static electricity remains on the medications 5, the remaining static electricity is further removed by the brush member 14, thus further enhancing the prevention of the medications 5 from being stuck in the groove 11 and failing to drop.

Figure 15:
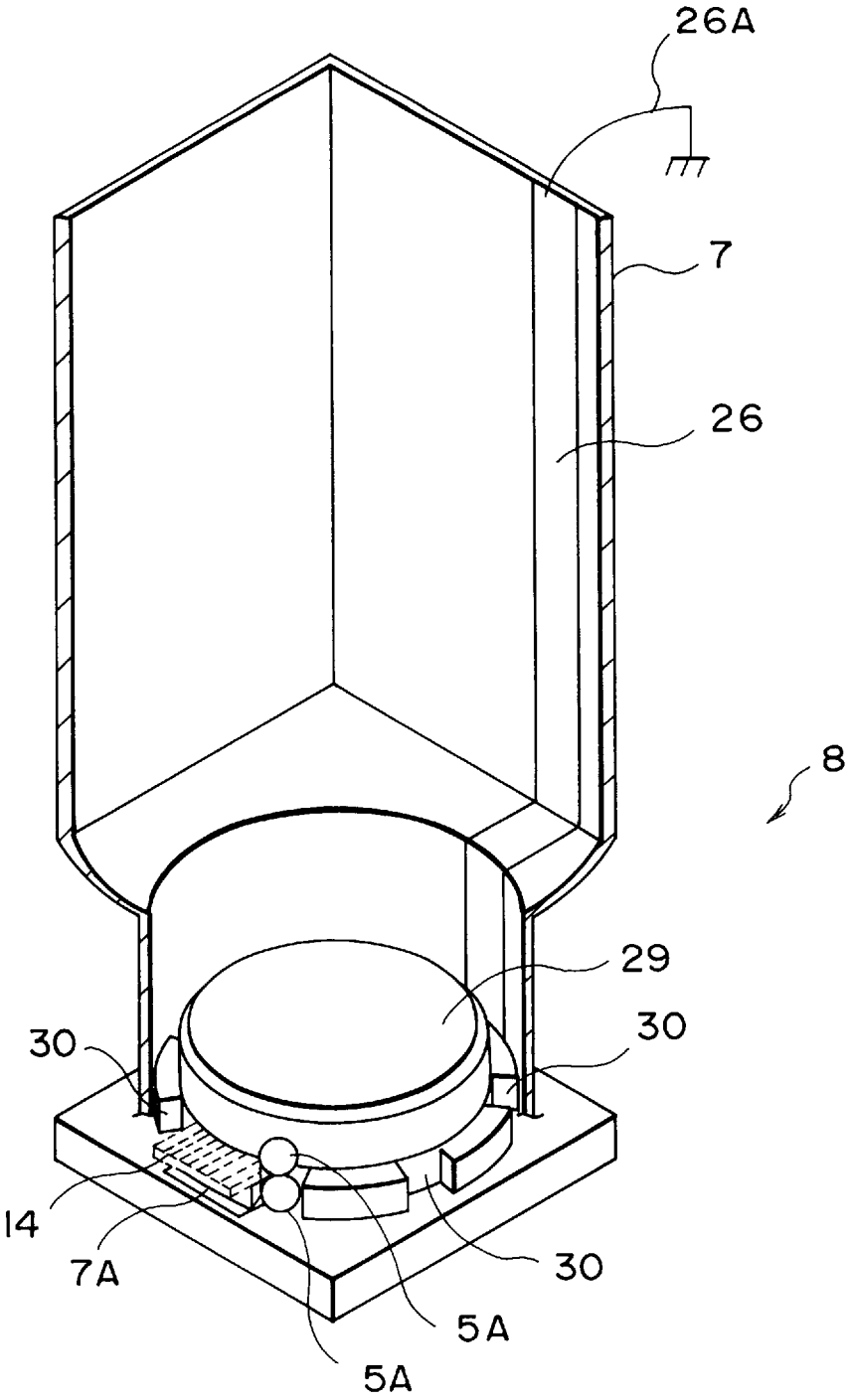
FIG. 15 is a partially cut away perspective view showing the interior of a tablet case of another embodiment, i.e. another dispensing drum, which is equipped with the case grounding plate.
Figure 16:
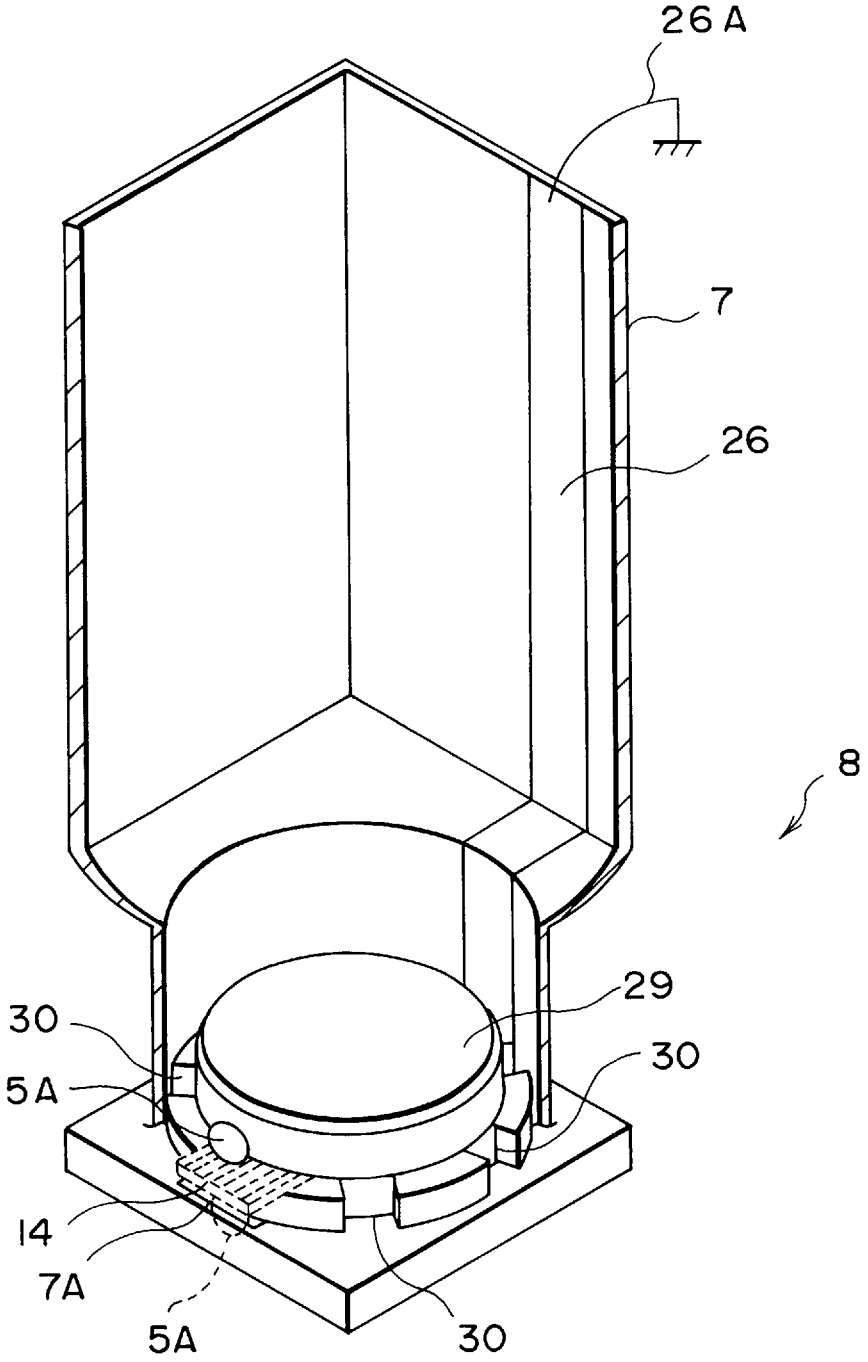
FIG. 16 is a partially cut away perspective view showing the interior of another tablet case of another embodiment, i.e. another dispensing drum, which is equipped with the case grounding plate.
Figure 17:
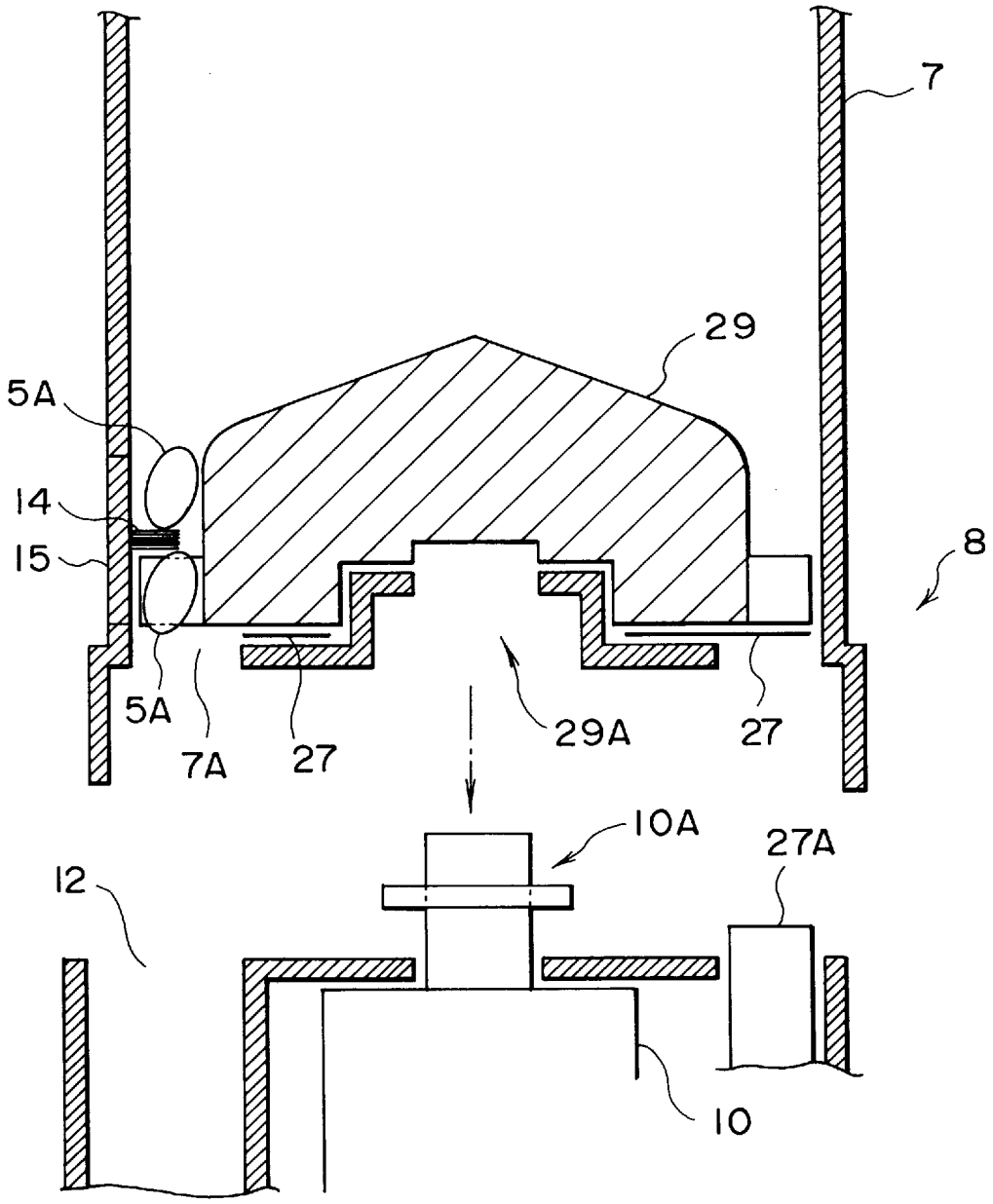
FIG. 17 is a longitudinal side view showing the bottom of the tablet case shown in FIG. 15.

Referring now to FIG. 15 through FIG. 17, an embodiment which employs a dispensing drum 29 having a different shape will be described. In this embodiment, the tablet case 7 holds medications 5A which are elliptical tablets having a predetermined thickness. In these drawings, like reference numerals given in FIG. 1 through FIG. 14 designate like components or components providing like functions. The dispensing drum 29 is driven by the drum rotating motor 10 as in the first embodiment and the control is carried out in the same manner as in the first embodiment.

The dispensing drum 29 of the dispensing & counting device dispensing & counting device 8 in this embodiment has a smaller vertical dimension; it is provided with a plurality of vertical grooves 30 on the side surface thereof. Medications 5A such as pills, lozenges, and other types of tablets are fed into the groove 5A one at a time. The brush member 14 juts out from side to cover the top of the grooves 30 of the dispensing drum 29.

The brush member (separating member) 14 which is the conductive member and which is provided on the side surface of the dispensing drum 29 is positioned over the groove 30 of the dispensing drum 29; it prevents more than one medications 5A from entering the groove 30. Thus, the brush member 14 permits only one medication 5A to drop at a time from the groove 30.

The brush member 14 is grounded with the conductive wire which is not shown. The tablet case 7 is provided with the case grounding plate 26, which is conductive, as in the first embodiment, so that it is grounded via the connected conductive wire 26A. Provided under the dispensing drum 29 is the drum grounding plate 27 serving as the conductive member. Other operations are available as in the first embodiment.

A still another embodiment of the medication filling apparatus 1 in accordance with the present invention will now be described in conjunction with FIG. 21 through FIG. 25. In these drawings, like reference numerals given in FIG. 1 through 20 designate like components or components providing like functions. The dispensing drum 9 and other component units are controlled in the similar manner as described in the embodiments described above.

The dispensing drum 9, i.e. the dispensing means, of the dispensing & counting device 8 is a hollow cylinder opened downward; there is provided a fitting section which extends downward from the top end of the inner center of the dispensing drum 9 and which is not shown; and the drum rotating motor 10 is provided under the dispensing drum 9. The fitting shaft, i.e. the rotary shaft, which is similar to that in the embodiments described above and which is not shown, juts out from the top surface of the drum rotating motor 10; the fitting shaft 10A fits in the fitting section of the dispensing drum 9. When the tablet case 7 is mounted, the fitting section of the dispensing drum 9 fits onto the fitting shaft of the drum rotating motor 10.

A shielding plate 51 serving as a shielding means is provided on the bottom surface of the tablet case 7. The shielding plate 51 is constituted by: a nearly annular base 52; a shielding section 53 which projects outward from a part of the outer circumference of the base 52; a friction wall 54 which extends from the top surface of the base 52 into the dispensing drum 9 above and which has a arcuate cross section (only one is shown in this embodiment; however, providing a plurality of the friction wall will add to reliability); and an arcuate slot 56 formed on the base 52. The shielding plate 51 is rotatably disposed at the bottom of the dispensing drum 9 in such a manner that it is concentric with the dispensing drum 9. The shielding section 53 has an adequate area for covering the outlet 7A; it is located over the outlet 7A. The fitting section of the dispensing drum 9 or the fitting shaft of the drum rotating motor 10 passes through the center of the base 52.

A pin 57 extends from the bottom surface of the tablet case 7; it engages in the slot 56 of the base 52 of the shielding plate 51. This allows the shielding plate 51 to turn within the slot 56. A first spring (tension spring) 58 is installed between the pin 57 and the end of the slot 56 on the shielding section 53 side. The urging force of the spring 58 holds the shielding plate 51 in place so that the outlet 7A is closed by the shielding section 53 at all times (FIG. 21).

Figure 21:
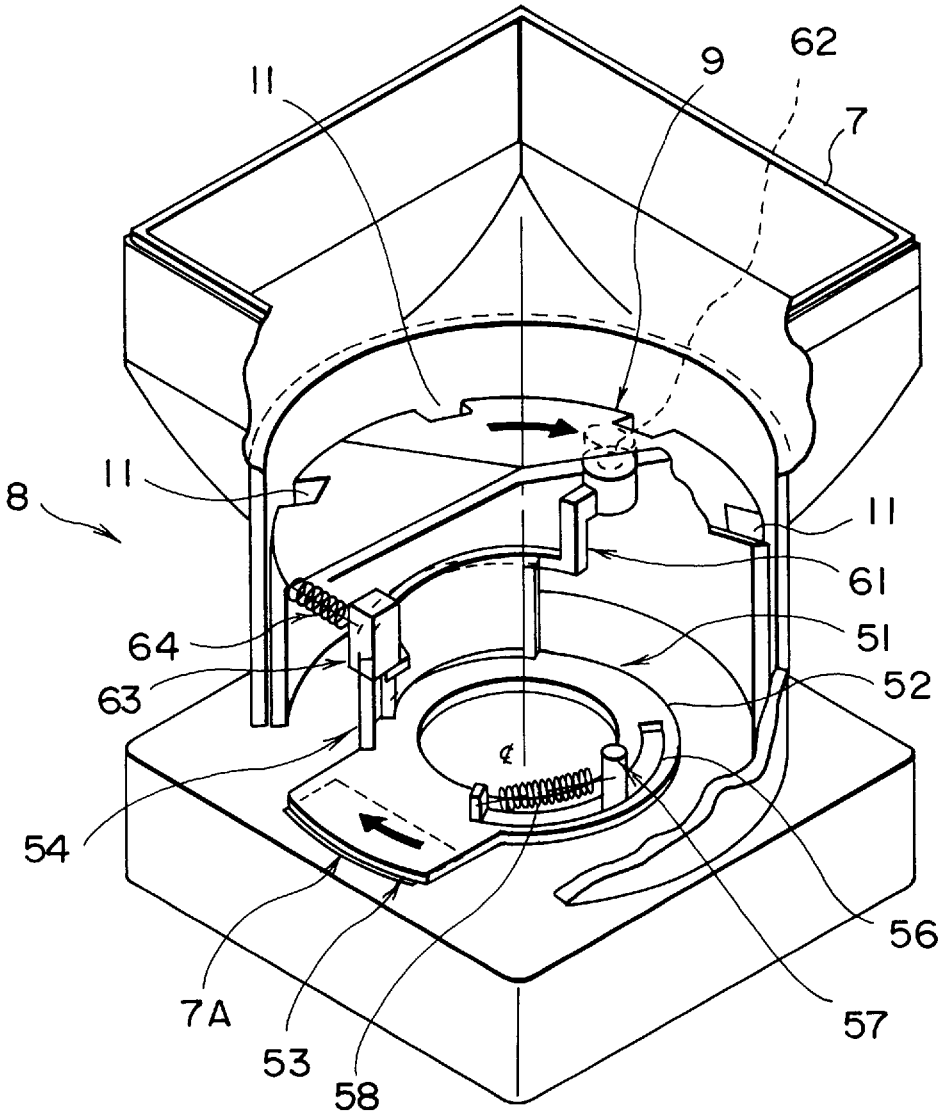
FIG. 21 is a partially cut away perspective view showing a tablet case of another embodiment.

When the shielding plate 51 is turned in the direction of the arrow in FIG. 21 against the urging force, i.e. the pulling force, applied by the spring 58, the shielding section 53 opens the outlet 7A.

Figure 22:
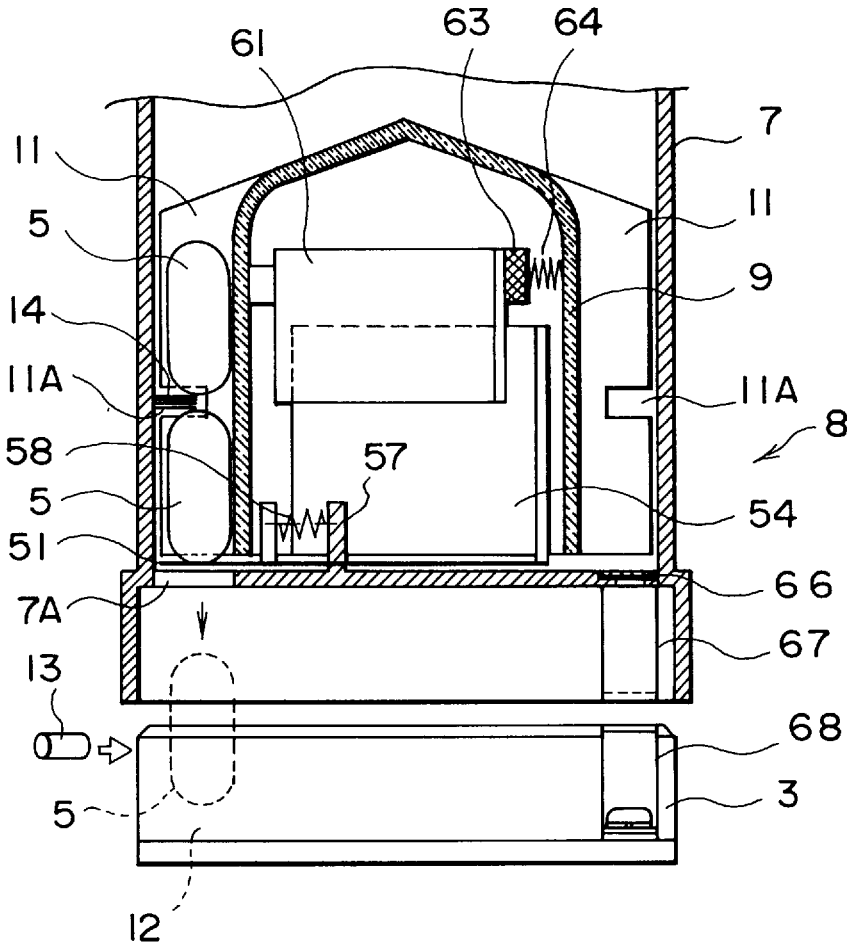
FIG. 22 is a longitudinal side view showing the bottom of the tablet case shown in FIG. 21.
Figure 23:
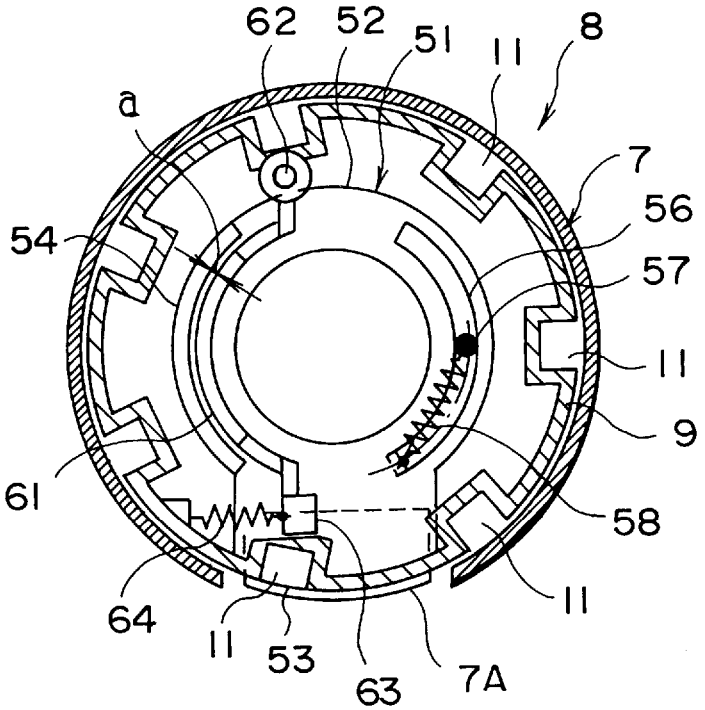
FIG. 23 is a top sectional view showing the bottom of the tablet case shown in FIG. 21.

Installed in the dispensing drum 9 is a centrifugal arm 61 serving as a driving means. The centrifugal arm 61 has an arcuate external shape which matches the inner wall shape of the friction wall 54; it is rotatably mounted to one edge of the inner wall of the dispensing drum 9 at a rotary shaft 62 which is attached to one end of the centrifugal arm 61. Thus, the centrifugal arm 61 is located inside the friction wall 54 (FIG. 22 shows the dispensing drum 9 which has turned 90 degrees from the state illustrated in FIG. 21).

A weight 63 is attached to the other end of the centrifugal arm 61; a second spring 64, which is a compression spring, is installed between the weight 63 and the inner surface of the side wall of the dispensing drum 9. The spring 64 always urges or stretches the centrifugal arm 61 so that it stays away from the friction wall 54 with a gap "a" between them; if the spring 64 is compressed against the urging force, then the outer surface of the centrifugal arm 61 comes in contact with the inner surface of the friction wall 54 with a predetermined frictional force.

An annular conductive plate 66 with the portion of the outlet 7A cut out is mounted on the bottom surface of the tablet case 7 in the rotating range of the grooves 11. The conductive plate 66 is located under the shielding plate 51; the lowermost one among the medications 5 which have been fed into the groove 11 comes in contact with the conductive plate 66 which is grounded through the contact with a conductive plate 68 fixed to the outer case 3 via a conducting plate 67 when the tablet case 7 is installed.

The operation of the embodiment with the configuration described above will now be described. When the power is ON, the dispensing drum 9 is in a stopped state, the centrifugal arm 61 is spaced away from the friction wall 54 by the spring 64, the shielding plate 51 is pulled by the spring 58, and the shielding section 53 closes the outlet 7A. Hence, normally, the outside air does not enter into the tablet case 7 through the outlet 7A, preventing the medications 5 from absorbing humidity and deteriorating or degrading. Furthermore, even when the tablet case 7 is detached and attached back again for supplying the medications 5 or for cleaning the tablet case 7, medications 5 do not accidentally drop out of the outlet 7A.

Based on prescription data, the drum rotating motor 10 of the dispensing & counting device dispensing & counting device 8 of the tablet case 7 holding the type of medications 5 specified in the prescription data is driven as previously described. When the dispensing drum 9 is rotated in the direction of the arrow shown in FIG. 21, the centrifugal arm 61 rotates together with the dispensing drum 9; at this time, the centrifugal arm 61 turns around the rotary shaft 62 against the urging force of the spring 64 due to the centrifugal force so that the weight 63 on the other end moves outward.

Figure 24:
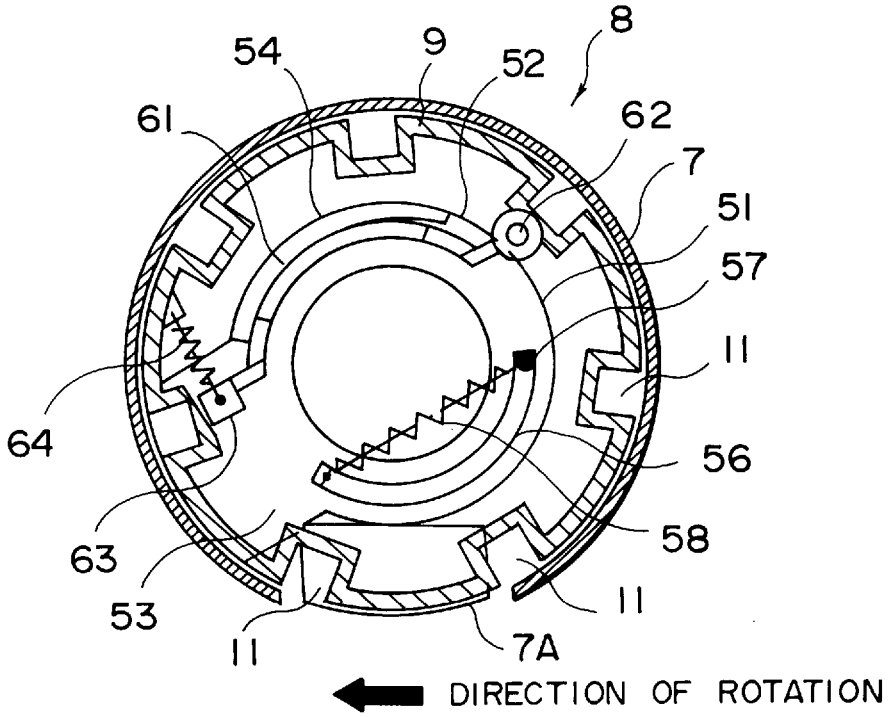
FIG. 24 is a top sectional view showing the bottom of the tablet case shown in FIG. 21 for illustrating the operation of a shielding plate.

This causes the outer surface of the centrifugal arm 61 to come in contact with and pressed against the inner surface of the friction wall 54; therefore, the frictional force at this time causes the shielding plate 51 to turn also in the rotational direction of the dispensing drum 9 against the urging force of the spring 58. This in turn causes the shielding section 53 of the shielding plate 51 to open the outlet 7A as previously described (FIG. 24). Then, the medication 5 drops from the groove 11 which is aligned with the opened outlet 7A. The dimensions of the centrifugal arm 61 are set so that a portion thereof comes in contact with the friction wall 54 to open the outlet 7A during the rotation of the dispensing drum 9.

When the number of dropped medications 5 coincides with the number of the medications based on the prescription data, the microprocessor 45 decides that the counting has been completed and it stops supplying electric currents to the drum rotating motor 10.

Stopping the supply of electric currents to the drum rotating motor 10 stops the dispensing drum 9; as the revolution of the dispensing drum 9 changes, that is, slows down, and the centrifugal force on the centrifugal arm 61 weakens, the centrifugal arm 61 is immediately pushed inward by the spring 64, leaving the friction wall 54. This causes the shielding plate 51 to be pulled back by the spring 58 and the outlet 7A is closed by the shielding section 53.

Hence, even when the dispensing drum 9 continues to rotate owing to inertia force, although it is actually an extremely short time, after the supply of electric currents to the drum rotating motor 10 is stopped, the medications 5 are prevented from being dispensed from the groove 11, thus assuring the prevention of over-dispensing. Therefore, the rotational speed of the dispensing drum 9 can be increased to shorten the time required for dispensing without the problem of over-dispensing.

Moreover, although the medications 5 in the tablet case 7 are charged with static electricity owing to the rotation of the dispensing drum 9 or other reason, the medications 5 fed in the groove 11 come in contact with the conductive plate 66 whenever they reach the lowest level in the groove, so that the static electricity is discharged from the medications 5 to the outer case 3 via the conductive plate 66, and the conducting plates 67 and 68.

Thus, the static electricity is removed from the medications 5, preventing a dispensing failure from taking place due to the medications 5 being stuck to the tablet case 7 or dispensing drum 9.

Figure 25:
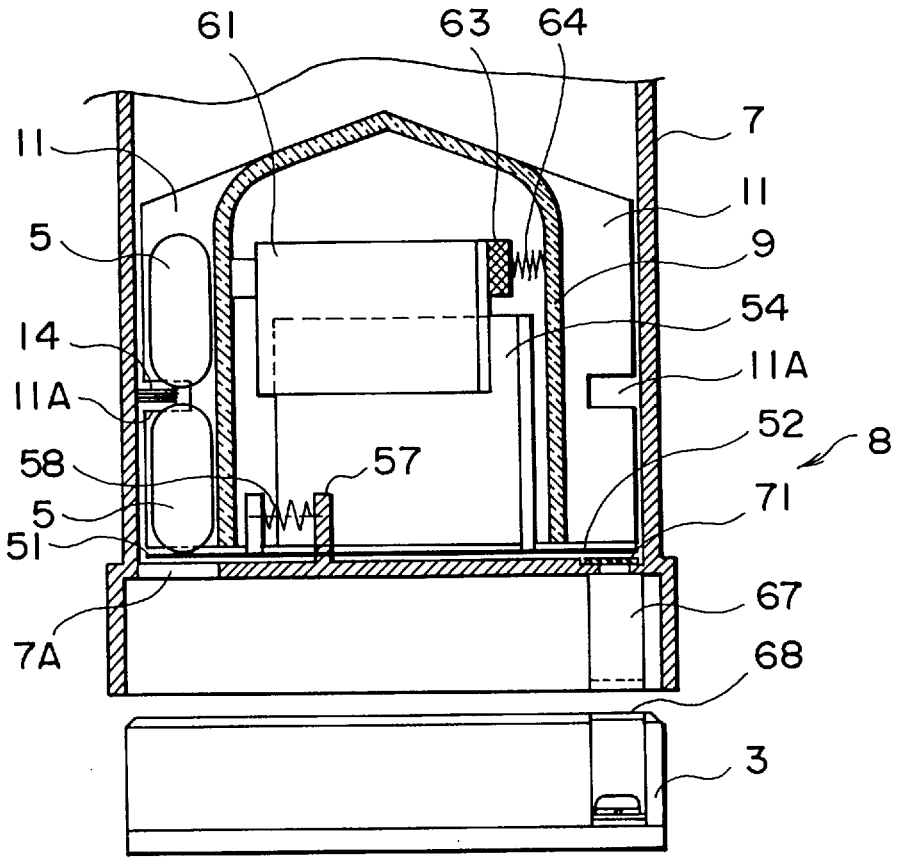
FIG. 25 is a longitudinal side view showing the bottom of the tablet case illustrating still another embodiment.

FIG. 25 shows yet another embodiment of the tablet case 7 and dispensing & counting device dispensing & counting device 8 in accordance with the present invention which correspond to the one shown in FIG. 22. In this embodiment, the shielding plate 51 does not have the shielding section 53; instead, the width of the base 52 has been increased and the whole outer section thereof is located under the full area where the grooves 11 of the dispensing drum 9 rotate. The base 52 is also provided with a through hole or notch, not shown; the base 52 normally closes the outlet 7A, but when it rotates as the dispensing drum 9 is rotated and the through hole or notch is aligned with the outlet 7A, it opens the outlet 7A.

The shielding plate 51 in this embodiment is composed of a conductive material such as a metal plate, and a conductive plate 71 is in contact with the bottom surface thereof. The conductive plate 71 is grounded via the conducting plates 67 and 68 as in the aforementioned embodiments.

According to this embodiment, the shielding plate 51 also provides the function of the conductive plate 66 in the aforementioned embodiments, and the conductive plate 71 can be made smaller, enabling better assemblability and reduced material cost.

In the embodiments described above, the brush member 14 is used as the separating member. The separating member, however, is not limited to the brush member; it may be an elastic member such as a sponge member which exhibits the similar function.

Likewise, in the embodiments described above, only one case grounding plate 26 is installed in the tablet case 7; however, two or more case grounding plates 26 may be provided in the tablet case 7. As another alternative, the case grounding plate may be provided in the whole interior of the tablet case 7.

The metal plate such as a stainless steel plate is employed for the case grounding plate 26 in the embodiments; however, cloth or the like made of conductive fiber with carbon or the like mixed therein may be used instead.

Further, although the vials are used as the containers in the respective embodiments, the type of container to be used is not limited thereto; the present invention can be also effectively implemented also when packaging paper which is formed into a bag is used as the container.

Thus, the medication filling apparatus in accordance with the present invention is useful for filling a container such as a vial or bag with medications including tablets, capsules, pills, and lozenges in a quantity specified by a prescription at a hospital, pharmacy, or the like; it is particularly suited for charging many different types of medications.

What is claimed is:

1. A medication filing apparatus comprising:

a fixed tablet case for holding a mediation, a dispensing drum adjacent the tablet case, which drum rotates to let the medication from the tablet case drop out of an outlet to dispense the medication, wherein a plurality of grooves are formed vertically on a side surface of the dispensing drum into which the medications are fed from the tablet case and which let the medications drop therefrom when the grooves are aligned with the outlet; and a separating member which extends out into or over the grooves aligned with the outlet, said separating member being located about one tablet length below said tablet case, the separating member being of a material which has predetermined lateral and longitudinal dimensions and also has certain flexibility.

2. A medication filling apparatus comprising:

a fixed tablet case for holding a medication, a dispensing drum adjacent the tablet case, which drum rotates to let the medication from the tablet case drop out of an outlet to dispense the medication, wherein a plurality of grooves are formed vertically on a side surface of the dispensing drum into which the medications are fed from the tablet case and which let the medications drop therefrom when the grooves are aligned with the outlet; and a separating member extending out into or over the grooves aligned with the outlet, said separating member being located about one tablet length below said tablet case, the separating member being of a material which exhibits certain flexibility in the radial direction of the dispensing drum.

3. A medication filling apparatus comprising:

a tablet case for holding a medication, a dispensing drum adjacent the tablet case, which drum rotates to let the medication from the tablet case drop out of an outlet to dispense the medication, wherein a plurality of grooves are formed vertically on a side surface of the dispensing drum into which the medications are fed from the tablet case and which let the medications drop therefrom when the grooves are aligned with the outlet; and a brush member which extends out into or over the grooves aligned with the outlet said separating member being located about one tablet length below said tablet case.

4. A medication filling apparatus according to claims 1, 2, or 3, further comprising an electrically conductive member on a lower surface adjacent the grooves in the rotating dispensing drum so as to contact medication in the groove, the conductive member being grounded.

5. A medication filling apparatus according to claims 1, 2, or 3, wherein the separating member or the brush member contacts a medication in a groove and is an electrically conductive member and is electrically grounded.

6. A medication filling apparatus according to claims 1, 2, or 3, further comprising shielding means which normally closes the outlet and opens the outlet when the dispensing drum rotates for dispensing.

7. A medication filling apparatus comprising:

a tablet case for holding a medication, and a dispensing drum adjacent the tablet case, which drum rotates to let the medication from the tablet case drop out of an outlet to dispense the medication, a plurality of grooves formed vertically on a side surface of the dispensing drum into which the medications are fed from the tablet case and which let the medications drop therefrom when the grooves are aligned with the outlet;

a separating member or a brush member which extends into or over the grooves aligned with the outlet to contact a medication in a groove, shielding means which opens and closes the outlet, but normally closes the outlet; and driving means which is normally spaced away from the shielding means, but comes in contact with the shielding means due to centrifugal force generated when the dispensing drum rotates so as to open the outlet.

8. A medication filling apparatus comprising:

a tablet case for holding a medication, and a dispensing drum adjacent the tablet case, which drum rotates to let the medication drop out of an outlet from the tablet case to dispense the medication, a plurality of grooves formed vertically on a side surface of the dispensing drum into which the medications are fed from the tablet case and which let the medications drop therefrom when the grooves are aligned with the outlet;

a separating member or a brush member which extends into or over the grooves aligned with the outlet to contact a medication in a groove, a shielding which is positioned below the grooves and which rotates to open or close the outlet;

a first spring which always urges the shielding plate in a direction for closing the outlet;

a centrifugal arm which is rotatably provided in the dispensing drum and which is detachably in contact with the shielding plate; and a second spring which always urges the centrifugal arm in a direction for moving it away from the shielding plate;

wherein the centrifugal arm is normally spaced away from the shielding plate by the second spring;

the shielding plate closes the outlet by the first spring; and the centrifugal arm rotates against the second spring due to a centrifugal force generated by the rotation of the dispensing drum and it comes in contact with the shielding plate, causing the shielding plate to turn against the first spring so as to open the outlet.

9. A medication filling apparatus according to claim 8, wherein the shielding plate is composed of an electrically conductive material and is grounded.

10. A medication filling apparatus comprising:

a tablet case for holding a medication, and a dispensing drum adjacent the tablet case, which drum rotates to let the medication from the tablet case drop out of an outlet to dispense the medication, a plurality of grooves formed vertically on a side surface of the dispensing drum into which the medications are fed from the tablet case and which let the medications drop therefrom when the grooves are aligned with the outlet;

a separating member or a brush member which extends out into or over the grooves aligned with the outlet to contact a medication in a groove, and an electrically conductive member on the inner wall of the tablet case adjacent such grooves, the conductive member being grounded.

11. A medication filling apparatus according to claim 10 wherein said separating member is of a material which has predetermined lateral and longitudinal dimensions and also has a certain flexibility.

12. A medication filling apparatus according to claim 10 wherein said separating member is of a material which exhibits a certain flexibility in the radial direction of the dispensing drum.

13. A medication filling apparatus according to claim 7 wherein said separating member is of a material which has predetermined lateral and longitudinal dimensions and also has a certain flexibility.

14. A medication filling apparatus according to claim 7 wherein said separating member is of a material which exhibits a certain flexibility in the radial direction of the dispensing drum.

15. A medication filling apparatus according to claim 8 wherein said separating member is of a material which has predetermined lateral and longitudinal dimensions and also has a certain flexibility.

16. A medication filling apparatus according to claim 8 wherein said separating member is of a material which exhibits a certain flexibility in the radial direction of the dispensing drum.

* * * * *